United States Patent [19]

Tachihara et al.

[11] 4,394,557

[45] Jul. 19, 1983

[54] ELECTRONIC CONTROLLED HEAT COOKING APPARATUS

[75] Inventors: Jin Tachihara, Oumihachiman; Hideaki Koyama, Otsu, both of Japan

[73] Assignee: Sanyo Electric Co., Ltd., Moriguchi, Japan

[21] Appl. No.: 151,609

[22] Filed: May 20, 1980

[30] Foreign Application Priority Data

Jun. 13, 1979 [JP] Japan ..... 54-75024
Jun. 13, 1979 [JP] Japan ..... 54-75026

[51] Int. Cl.[3] ..... H05B 1/02

[52] U.S. Cl. ..... 219/10.55 B; 219/506; 219/492

[58] Field of Search ..... 219/10.55 B, 10.55 F, 219/506, 492, 10.55 R; 99/325, DIG. 14; 364/400, 101; 340/147 P, 584, 711, 309.1

[56] References Cited

U.S. PATENT DOCUMENTS 4,011,428 3/1977 Fosnough et al. ..... 219/506
4,158,432 6/1979 Van Bavel ..... 219/10.55 B
4,158,759 6/1979 Mason ..... 219/10.55 B
4,177,370 12/1979 Otani ..... 219/10.55 B
4,198,553 4/1980 Dills ..... 219/10.55 B
4,206,872 6/1980 Levine ..... 219/492

FOREIGN PATENT DOCUMENTS 52-38657 3/1977 Japan ..... 219/10.55 B
54-15545 2/1979 Japan ..... 219/10.55 B

*Primary Examiner*—M. H. Paschall
*Attorney, Agent, or Firm*—Darby & Darby

[57] ABSTRACT

An electronic controlled heat cooking apparatus having a plurality of heating mode designating keys and a timer allotted to each of a plurality of blocks for setting heating conditions of an oven. A random access memory included in a microprocessor stores which block's heating mode designating key was first operated from the plurality of blocks and also stores the set heating mode and the time period set by the timer of that block. The microprocessor is responsive to an operation of a start key to select the heating modes of the oven in accordance with the order as stored in the random access memory and enable the oven's appropriate heat source in the selected heating mode for the set time period of the corresponding timer. Each timer has a displaceable operation knob, and a digital display is provided to display the timer time period information set by the knob.

13 Claims, 18 Drawing Figures

201c

| | 0 | 1 | 2 | 3 | 4 | 5 | 6 | 7 | 8 | 9 | A | B | C |
|---|---|---|---|---|---|---|---|---|---|---|---|---|---|
| 0 | DISPLAY | | | | NT | | FKB | | | | | | |
| 1 | CLOCK | | | | OT 1 | | FLG | | | | | | |
| 2 | TIME 1 | | | | OT 2 | | | | | | | | |
| 3 | TIME 2 | | | | FLG | | | | | | | | |

| FLG | | | | | | | | | | | |
|---|---|---|---|---|---|---|---|---|---|---|---|
| FLG 1 | FLG 2 | FLG 3 | FLG 4 | FLG 5 | FLG 6 | FLG 7 | FLG 8 | FLG 9 | FLG 10 | FLG 11 | |

ELECTRONIC CONTROLLED HEAT COOKING APPARATUS

BACKGROUND OF THE INVENTION

1. Field of the Invention

The present invention relates to an electronic controlled heat cooking apparatus. More specifically, the present invention relates to an electronic controlled heat cooking apparatus such as a microwave oven which employs a microprocessor for controlling a heat cooking.

2. Description of the Prior Art

Of late a microprocessor has been utilized in a heat cooking apparatus such as a microwave oven, in the light of the advantage that a variety of cooking modes can be performed with a relatively simple structure. In case of such an electronic controlled heat cooking apparatus employing a microprocessor, it is necessary to enter information for control to the microprocessor. It has been common that entry means of the so-called ten-key type has been employed as such information entry means. Accordingly, even in entering a timer time period for the purpose of a timer operation mode, for example, the ten-key type entry means had to be operated; however, it was not easy to operate such entry means for setting the above described timer time period to an operator not familiar with an arrangement of keys in the ten-key type entry means.

Although a conventional cooking apparatus is structured to display by a display means at the beginning the timer time period entered by the above described cooking input operation, the display means was merely adapted to indicate only the left time period after once a heating operation is initiated. Accordingly, it was impossible to confirm the timer time period originally entered after the heat operation is completed, even when it is desired to confirm such timer time period.

For example, in the case where the cooking operation is made first with a strong intensity, which is then to be followed automatically by the cooking operation with a weak intensity, a keying input operation must be made for each of the mode setting, i.e. the setting of the first heating mode and the following heating mode, and in total two times, with the result that a keying input operation becomes complicated. Furthermore, according to the conventional approach, in performing two heating modes in succession in the above described manner, a timer time period in the second heating mode is not displayed by a display means after the heating operation is initiated until after the second heating mode is completed and the timer time period of the following heating mode was not able to be confirmed at all.

SUMMARY OF THE INVENTION

In summary, the present invention comprises a plurality of heating condition setting means, storing means for storing the order of the heating conditions and other information, and control means for controlling heating energy generating means in accordance with the stored order and the set information.

According to the present invention, the heating mode is performed automatically in the order as entered by the heating condition setting means and in the respective heating modes and accordingly redundant keying input operations for designating the order of the operations can be dispensed with. As a result, an electronic controlled heat cooking apparatus which is excellent in convenience of a simple operation is provided.

In a preferred embodiment of the present invention, the plurality of heating condition setting means are included in the respective corresponding blocks and to that end the storing means is adapted to store the order of the operations on a block unit basis. Therefore, even in the case of successive operations, a complicated control can be dispensed with. Since a timer time period entry means is provided as a heating condition setting means, a timer operation mode can be performed with simplicity.

In another preferred embodiment of the present invention, timer time period entry means included in each of the blocks comprises an operation knob displaceably provided, and code signal generating means for generating a code signal associated with a displaced amount of the operation knob. When any one of the timer operation knobs is displaced, the timer time period information set by the operation knob as last displaced is displayed. Therefore, according to the embodiment, the heating conditions are set such that a plurality of timer operation modes can be performed in succession and as a result such a complicated keying input operation as required conventionally can be dispensed with, with the result that the convenience of the key operation is much improved. In the preferred embodiment, since the time period as set by the operation knob last displaced is selectively displayed, common display means can be used for a plurality of timer means.

In a further preferred embodiment of the present invention, a timer left time period is evaluated from time to time and the left time period is displayed by the display for each of the corresponding heating modes. Therefore, according to the preferred embodiment, even in the case of consecutive timer operations, the corresponding left time period can be confirmed with ease.

In still a further preferred embodiment of the present invention, block display means is provided for displaying which block's heating condition setting means is operated for setting the heating condition. The block display means is also used for displaying the above described left time period and accordingly the condition setting operation, the heating mode presently in operation and the left time period can be confirmed with more facility.

In still another preferred embodiment of the present invention, since the timer operation knob is structured such that even after the operation thereof is released the displaced position by the operation may be maintained, the timer time period as set can be readily confirmed even in the case of the consecutive timer operations. More specifically, according to a conventional approach, a timer time period as set by the second and further setting operations was not displayed until after the second and further heating modes are completed, whereas according to the preferred embodiment, the timer time period of the second and further heating modes can be confirmed with simplicity by the positions of such timer operation knobs.

Accordingly, a principal object of the present invention is to provide an improved electronic controlled heat cooking apparatus.

Another object of the present invention is to provide an electronic controlled heat cooking apparatus, wherein the operations for setting consecutive cooking operations can be made with simplicity.

A further object of the present invention is to provide an electronic controlled heat cooking apparatus adapted for enabling a timer operation, wherein consecutive timer operation modes can be set with a convenience of operation.

Still a further object of the present invention is to provide an electronic controlled heat cooking apparatus, wherein even in setting consecutive timer operation modes a left timer time period of the timer time period as set can be confirmed with ease.

These objects and other objects, features, aspects and advantages of the present invention will become more apparent from the following detailed description of the present invention when taken in conjunction with the accompanying drawings.

DESCRIPTION OF THE PREFERRED EMBODIMENTS

In the following detailed description of the preferred embodiments of the present invention, the present invention will be described as advantageously employed in a microwave oven. However, it should be pointed out that the present invention is not limited to such embodiments but the present invention can be employed in any other types of heat cooking apparatuses for cooking a material being cooked by application of heat thereto, such as a gas oven, an electric oven, an electric grill, an electric roaster and the like.

Figure 1:
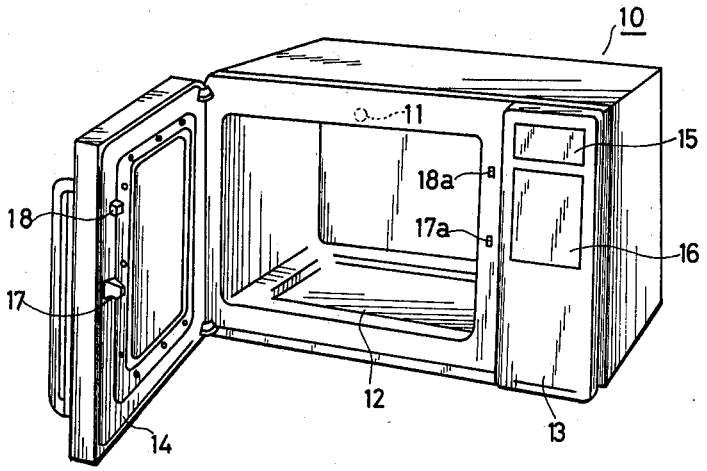
FIG. 1 is a perspective view of a microwave oven shown as one example of an electronic controlled heat cooking apparatus, which constitutes the background of the invention and wherein the present invention can be advantageously employed.

FIG. 1 is a perspective view of a microwave oven embodying the present invention. A microwave oven 10 has a main body comprising a cooking chamber 12 and a control panel 13. The main body of the microwave oven has a door 14 openably/closably provided to enclosure an opening of the cooking chamber 12. The control panel 13 comprises an operation portion 16 for setting various cooking modes and for entering necessary data, and a display 15 for displaying in a digital manner the entered data, a measured temperature, a time period left in a timer, and the like. The display portion 15 and the operation portion 16 will be described in more detail subsequently. The door 14 is provided with a door latch 17 and a door switch knob 18 on the inner surface thereof. The door latch 17 and the door switch knob 18 are adapted to enter into apertures **17*a* and 18*a*, respectively, formed on the main body, when the door 14 is closed, so that an interlock switch and a door switch, respectively, shown in FIG. 6**, may be turned on.

Figure 6:
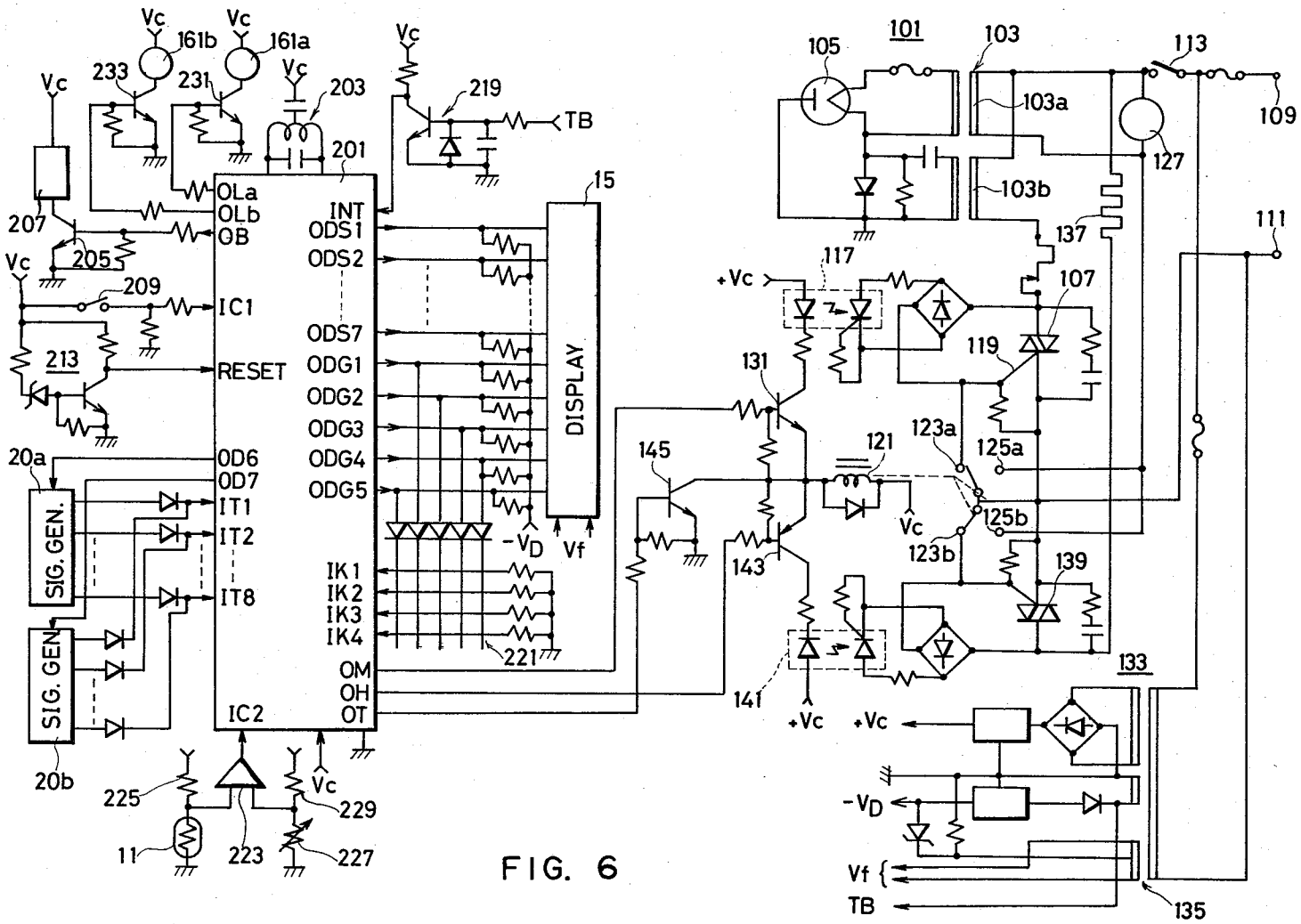
FIG. 6 is a schematic diagram of one embodiment of the present invention.

FIG. 6 is a schematic diagram of a preferred embodiment of the present invention. A microwave generating portion 101 is coupled to terminals 109 and 111 of a commercial power supply through an interlock switch 113 and a bidirectional thyristor 107. The microwave generating portion 101 is structured in a well known manner and may comprise a high voltage transformer 103 for transforming a source voltage obtained from the terminals 109 and 111, a magnetron 105 coupled to the output winding of the high voltage transformer 103, and the like. The interlock switch 113 is adapted to be turned on by means of the door latches 17 and **17*a*, shown in FIG. 1. The bidirectional thyristor 107 is rendered conductive if and when the output voltage of a photocoupler 117 is applied to the gate electrode 119 thereof. Accordingly, if and when the door 14 shown in FIG. 1 is closed and the output voltage is obtained from the photocoupler 117, an alternating source voltage obtained from the terminals 109 and 111 is applied to the microwave generating portion 101 and accordingly a microwave is generated from the microwave generating portion 101, which microwave energy is supplied to the cooking chamber 12 shown in FIG. 1. The photocoupler 117 becomes operative if and when two transistors 145 and 131 are both rendered conductive, whereby an output voltage is withdrawn. It is pointed out that the embodiment is structured to achieve a heat operation by a microwave oven and also to achieve a heat operation by a heater. To that end, the embodiment comprises a bidirectional thyristor 139 which is similar to the bidirectional thyristor 107. The bidirectional thristor 139 is used to control a power supply to a heater 137. A transistor 143, a photocoupler 141 and so on are provided in association with the bidirectional tyristor 139, as is similar to the bidirectional thyristor 107. The heater 137 is connected through an interlock switch 113 and the bidirectional thyristor 139 to the power supply terminals 109 and 111. The heater 137 is mounted on the upper wall of the cooking chamber 12 (FIG. 1), so that when the same is energized, the same is energized, the same is red heated, whereby the heating energy is applied to a material being cooked. If and when the transistors 145 and 143 are both rendered conductive, a signal is applied from the photocoupler 141 to the gate electrode of the bidirectional thyristor 139, whereby the heater 137 is supplied with electric power. The thyristor 107 is rendered conductive responsive to a signal from a photocoupler 117, when the transistors 145 and 131 are both rendered conductive, whereby the magnetron 105 is energized to generate a microwave. The relay 121 is energized when the transistor 145 is rendered conductive, whereby two normally open contacts 125*a* and 125*b* are closed while two normally closed contacts 123*a* and 123*b* are opened. Accordingly, upon energization of the relay 121, the blower motor 127 is energized and the current flows through the high voltage input winding 103*a* of the high voltage transformer 103. As a result, the cathode of the magnetron 105 is supplied with a current. The above described transistors 131, 143 and 145 are controlled to be conductive or non-conductive responsive to the outputs obtained at the output terminals OM, OH and OT of the microprocessor 201. The voltage source terminals 109 and 111 are further connected to a control voltage source 133. The control voltage source 133 comprises a transformer 135 for transforming the voltage supplied from the terminals 109 and 111 to a lower voltage for supplying direct current source voltage $V_C$ and $-V_D$ fed to various portions of the circuit, a voltage Vf fed to a display 15** and a time base signal TB.

The embodiment shown employs a one-chip microprocessor implemented as a large scale integration for controlling the above described microwave generating portion 101 and the like. The microprocessor 201 may be model "μPD553" manufactured by Nippon Electric Company Limited, Japan, for example. Such microprocessor 201 has a multiplicity of input and output terminals. Connection terminals OSC1 and OSC2 are used for connecting an external component 203 constituting a portion of a clock source. The external component 203 is cooperative with the microprocessor 201 to generate a synchronizing clock, so that the microprocessor 201, au execute the program steps in synchronism with the clock. Although not shown in the figure, the microprocessor 201 comprises a read only memory having system programs to be described subsequently, a random access memory for storing data, an arithmetic logic unit and the like, as well known to those skilled in the art.

Figure 3:
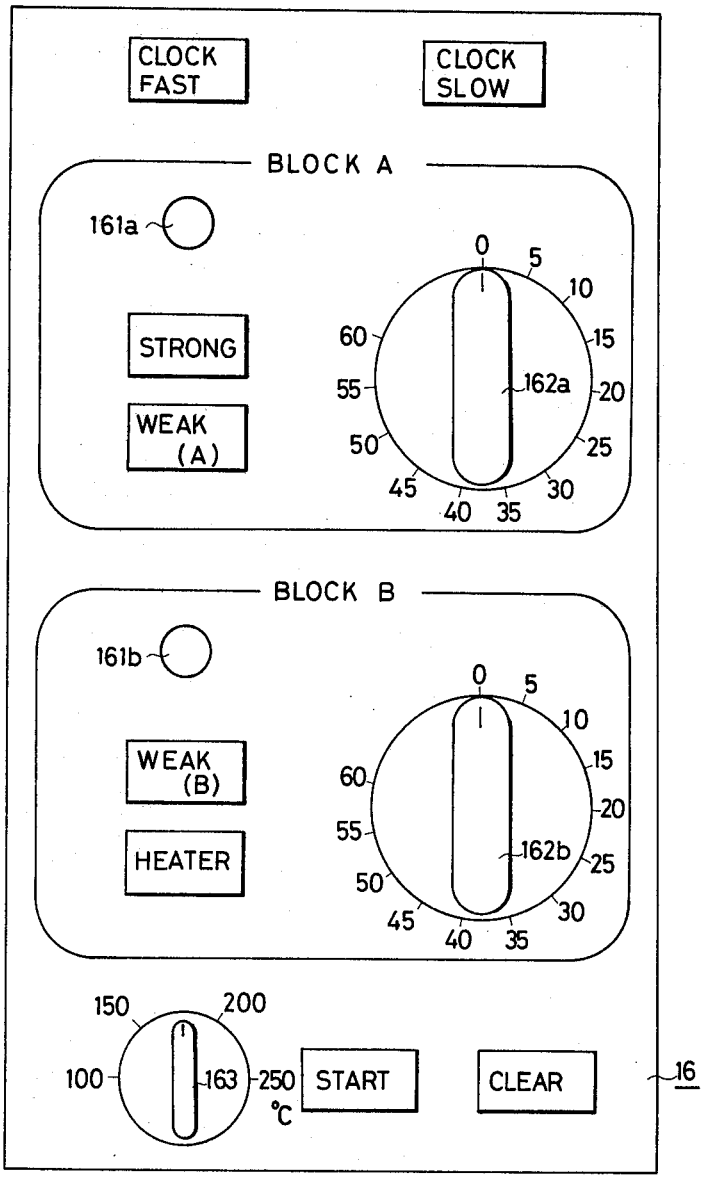
FIG. 3 is a view showing one example of an operation portion.

The microprocessor 201 is coupled to the display 15 through data output terminals ODS1 and ODS7. The display 15 is further supplied with a display control signal through control signal output terminals ODG1 and ODG5. The display control signal functions as a digit selecting signal for driving in a time sharing basis each of display digit to be described subsequently of the display 15. The control signal terminals ODG1 to ODG5 are coupled to column lines of a key matrix 221. The key matrix 221 comprises four row lines connected to key input terminals IK1, IK2, IK3 nd IK4 of the microprocessor 201. The above described column lines and row lines constitute a matrix, such that an intersection of each column line and each row line is provided with a key switch of the operation portion 16 (see FIG. 3). The operation portion 16 comprises five function keys, as shown in FIG. 3. The operation portion 16 comprises a MICROWAVE STRONG key and a MICROWAVE WEAK (A) key, a display lamp 161*a*, and timer operation knob 162*a* in the region in a circle indicated as "BLOCK A". The operation portion 16 further comprises a MICROWAVE WEAK (B) and a HEATER key, a display lamp 161*b* and a timer operation knob 162*b* in the region in a circle indicated as "BLOCK B". The operation portion 16 further comprises a CLOCK FAST key, a CLOCK SLOW key, a START key, a CLEAR key, and a temperature adjustment knob 163 disposed outside the above described circles. The above described keys may each comprise an ordinary contact type push botton switch. The temperature adjustment knob 163 is provided rotatably on the control panel 13 (FIG. 1), while the temperature graduations (C°) for "100", "150", "200", and "250" are indicated on the operation portion 16 along the periphery of the knob 163. A variable resistor, to be described subsequently, is provided on the rear of the control panel 13 so as to be rotated by the above described knob 163. The timer operation knobs 162*a* and 162*b* are also provided so as to be rotatable, while graduations for indicating the position "0" and the intervals for five minutes are indicated along the periphery of the knobs. Although not shown, the timer operation knobs 162*a* and 162*b* are operatively coupled to signal generators 20*a* and 20*b* (FIG. 6). The CLOCK FAST key and the CLOCK SLOW key are used for setting a time period. The CLEAR key is used for clearing the set command information. The START key is used for commanding initiation of microwave generation by the magnetron 105. The input from the key matrix 221 coupled to these keys is applied to the key input terminals IK1 to IK4 as a key code signal. The microprocessor 201 is responsive to the key code signal applied to the terminals IK1 to IK4 to detect or identify which key is depressed.

Figure 4:
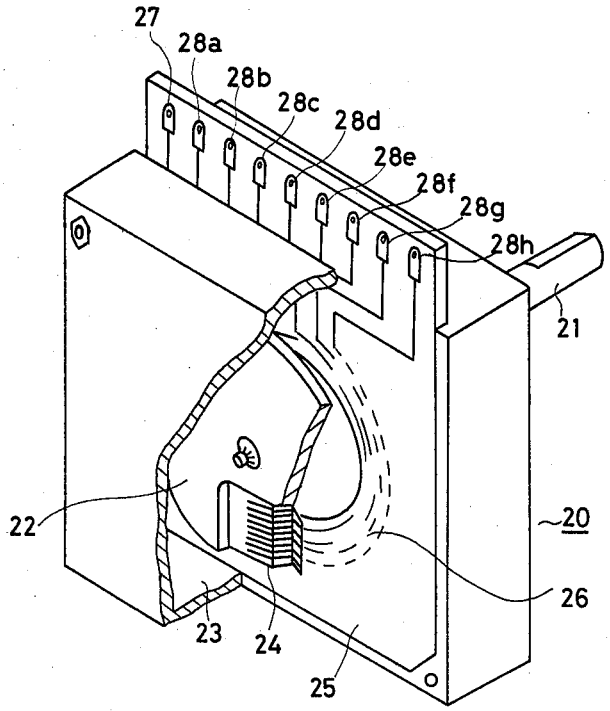
FIG. 4 is a fragmentary perspective view showing one example of a signal generator coupled in a ganged fashion with the operation knob.

FIG. 4 is a fragmentary perspective view of one example of the signal generator 20*a*. The signal generator 20 is provided on the rear surface of the control panel 13, so that the same is operatively coupled in a ganged fashion to the above described timer operation knob 162*a*. The signal generator 20*a* comprises an operation shaft 21 extending through the operation panel 13 to the front surface thereof and the operation shaft 21 is fitted to a hole, not shown, formed at the center of the rear surface of the timer operation knob 162*a*. Accordingly, the operation shaft 21 is rotated through rotation of the operation knob 162*a*. The other end of the operation shaft 21 extends through a printed circuit board 25. A rotation plate 22 is fixed to the other end so as to be integrally rotatable with the operation shaft 21. A common base portion of the conductive brush 24 is fixed to the rotation plate 22. Accordingly, when the operation shaft 21 is rotated by the knob 162*a*, the tip end of the brush 24 slides on the surface of the print circuit board 25. The print circuit board 25 is formed of a conductive pattern 26 along the sliding path of the brush 24. The conductive pattern 26 comprises nine conductive runs to be described subsequently. One of the nine conductive runs is connected to the common terminal 27, while the remaining eight conductive runs are connected to the corresponding first to eighth signal terminals 28*a* to 28*h*, respectively. The conductive pattern 26, the brush 24 and the rotation plate 22 are housed within a casing 22 constituting the signal generator 20*a*.

Figure 5B:
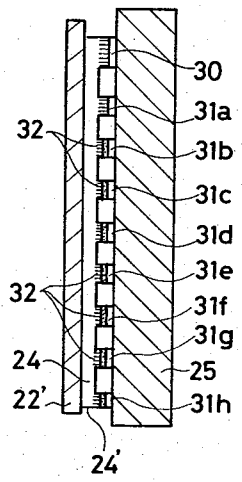
FIGS. 5A and 5B are views for explaining the FIG. 4 signal generator.
Figure 5A:
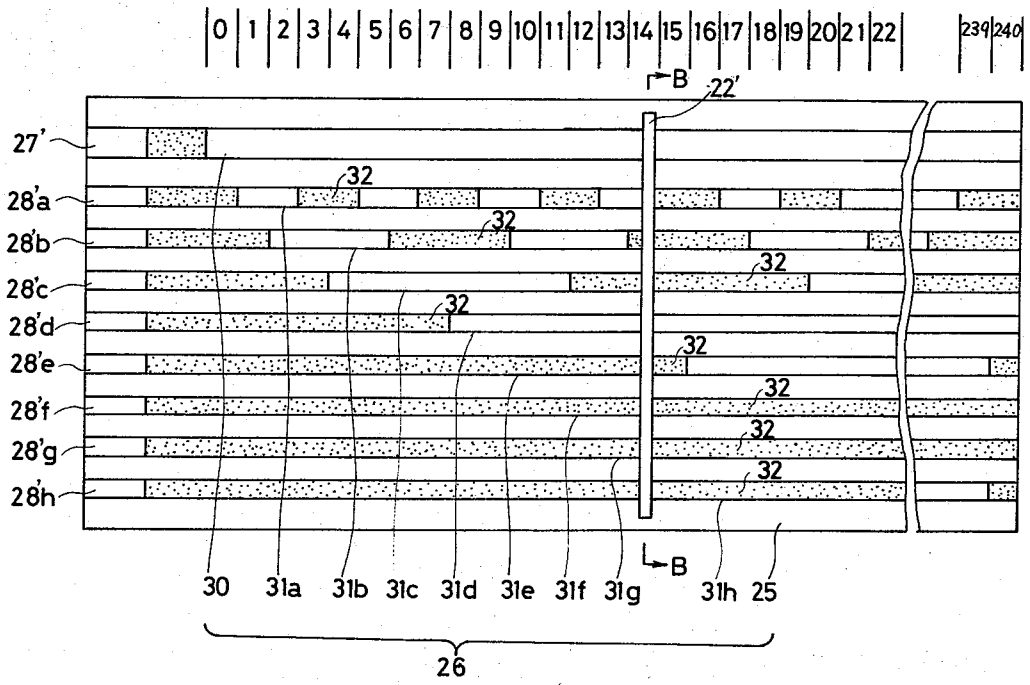

FIG. 5A is a view showing the above described conductive pattern 26 developed in a linear manner and FIG. 5B is a view showing a relation of the conductive pattern 26, the rotation plate 22 and the brush 24. Referring to FIG. 5A, the conductive pattern 26 formed on the surface of the printed circuit board 25 comprises one common run 30, and the first to eighth signal runs 31*a* to 31*h*, these common run and the signal runs being formed to extend in parallel. It would be appreciated that the movement of the brush 24 shown in FIG. 4 is equivalent to the movement along the extension direction of the conductive pattern 26 in FIG. 5A of the brush 24' extending perpendicular to the extension direction of the conductive pattern 26 in sliding contact with the common run 30 and the respective signal runs 31*a* to 31*h*.

The conductive pattern 26 is divided equispaced at the positions (unit portion) of 20 to 240. The position 0 is determined as the position of the brush 24' corresponding to the origin position of the operation knob 162*a* (FIG. 3) and the position 240 is determined as the position of the brush 24' corresponding to the position of sixty minutes of the operation knob 162*a*. Meanwhile, referring to FIG. 5A, the reference numeral 27' corresponds to the common terminal 27 in FIG. 4, and the reference numerals 28'*a* to 28'*h* correspond to the signal terminals 28*a* to 28*h* in FIG. 4, respectively. Referring to FIG. 5A, the portions as dotted on the respective conductive runs denote a portion where the insulating film 32 has been formed, where no electrical connection is established between the run and the brush even if the brush 24' is positioned. As understood from FIG. 5A, the common run 30 has been formed such that the conductive surface may be exposed in the full range from the position (unit portion) 0 up to the position 240. The first signal run 31*a* is formed such that the conductive surface may be exposed at the respective positions of "$A_1+4M_1$"th, where $A_1=1$, 2 and $M_1=0$ to 59. The second signal run 31*b* is formed such that the conductive surface may be exposed at the respective positions represented as the "$A_2+8M_2$"th, where $A_2=2$ to 5 and $M_2=2$ to 29. The third signal run 31*c* is formed such that the conductive surface may be exposed at the respective positions represented as the "$A_3+16M_3$"th, where $A_3=4$ to 11 and $M_3=0$ to 14. The fourth signal run 31*d* is formed such that the conductive surface may be exposed at the respective positions represented as the "$A_4+32M_4$"th, where $A_4=8$ to 23 and $M_4=0$ to 7. The fifth signal run 31*e* is formed such that the conductive surface may be exposed at the respective positions represented as the "$A_5+64M_5$"th, where $A_5=16$ to 47 and $M_5=0$ to 3. The sixth signal run 31*f* is formed such that the conductive surface may be exposed at the respective positions as represented as the "$A_6+128M_6$"th, where $A_6=32$ to 95 and $M_6=0$ or 1. The seventh signal run 31*g* is formed such that the conductive surface may be exposed at the respective positions as represented as the "$A_7$"th, where $A_7=64$ to 191. The eighth signal run 31*h* is formed such that the conductive surface may be exposed at the respective positions as represented as the "$A_8$"th, where $A_8=128$ to 239.

The signal generator 20*a* generates a code signal corresponding to an operated amount or a displaced amount of the timer operation knob 162*a* (FIG. 3). Consider a case where the brush 24' is at the fourteenth position, for example, as shown in FIG. 5A. One pulse is applied from the output terminal OD6 of the microprocessor 201 (FIG. 6) to the common terminal 27'. Then, the pulse signal is applied through the common terminal 27' and the common run 30 and through the brush 24' to the respective signal runs 28'*a* to 28'*h*. However, as far as the fourteenth position is concerned, only the first and fourth signal runs 31*a* and 31*d* have been formed such that the conductive surface may be exposed at that position. Accordingly, the above described pulse signal appears only at the first and fourth signal terminals 28'*a* and 28'*d* corresponding to the above described signal runs 31*a* and 31*d*. Accordingly, assuming that the presence or absence of the above described pulse signal corresponds to the logic one or zero, then the signal generation state at the respective signal terminals 28'*a* to 28'*h* corresponding to the respective signal runs 31*a* to 31*h* becomes "10010000". Likewise, the signal generation state at the other positions may be listed as shown in the following table.

TABLE

| Position | Signal Generation State | |
|---|---|---|
| 0 | 0000 | 0000 |
| 1 | 1000 | 0000 |
| 2 | 1100 | 0000 |
| 3 | 0100 | 0000 |
| 4 | 0110 | 0000 |
| 5 | 1110 | 0000 |
| . | . | . |
| . | . | . |

TABLE-continued

| Position | Signal Generation State | |
|---|---|---|
| . | . | . |

As apparent from the above described table, by displacing the operation knob 162*a*, a code signal of eight bits corresponding to the position of the brush 24' corresponding to the displacement is obtained. It is noted that a signal corresponding to the adjacent position contains only a variation of one bit. Such a code signal including a variation on a one bit by one bit basis is known as the so-called Gray code or the reflected binary code. The fact that the code signal obtained from the signal generator 20*a* is represented by the Gray code means that even in a state of the brush 24' at the border of two adjacent positions the resultant code signal in such a situation comes to correspond to either of the two adjacent positions. Accordingly, even in such a situation, a code signal corresponding to either position is obtained, whereby any malfunction is avoided in such a critical position.

Meanwhile, another signal generator 20*b* (FIG. 6) may also be structured in the same manner and the same may be operated in the same manner by means of a timer operation knob 162*b*.

The embodiment shown is further structured such that the input terminals IT1 to IT8 of the microprocessor 201 commonly receive the outputs of 8 bits obtained from two signal generators 20*a* and 20*b*. The microprocessor 201 comprises an output terminal OD6 for providing a pulse signal to the signal generator 20*a* and an output terminal OD7 for providing a pulse signal to the other signal generator 20*b*. The code signal of eight bits can assume 241 different combinations corresponding to 241 different positions. Accordingly, assuming that the portion of the conductive pattern 26 corresponding to the range of 0 to 60 minutes indicated on the periphery of the operation knob 19 is divided into 240 equispaced minor unit portions, then one minor unit portion corresponds to fifteen seconds, with the result that a different code signal is obtained for every fifteen seconds in setting a timer period by the knob 19.

Figure 2:
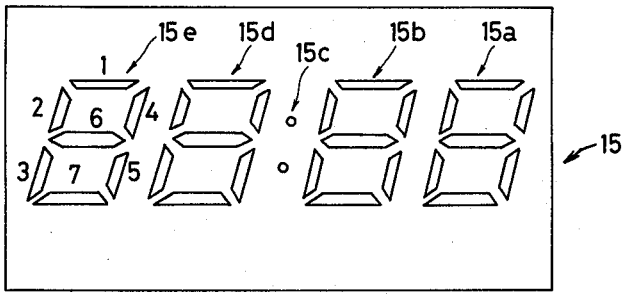
FIG. 2 is a view showing one example of a display.

The display 15 is structured as shown in FIG. 2, for example, by means of a fluorescent type display tube. More specifically, the display 15 comprises a numerical value display portion. The numerical value display portion comprises four numeral display portions 15*a*, 15*b*, 15*d* and 15*e*, each including an "8" shaped segment arrangement, and a colon display portion 15*c* formed between the numeral display portions 15*b* and 15*d*. The output signal obtained from the output terminals ODG1 to ODG5 of the microprocessor 201 functions as a digit selecting signal of the respective display digits 15*a* to 15*e*. On the other hand, the output signal obtained from the output terminals ODS1 to ODS7 functions as a segment selecting signal corresponding to the respective segments in each of the numeral display portions. Accordingly, if and when a signal is obtained from the output terminal ODG2, for example, and the output signal is obtained at the terminals ODS1, ODS3, ODS4, ODS6, and ODS7 a numeral "2" is displayed at the numeral display portion 15*b* is enabled to emit light. The output signal obtained from the output terminal ODS7 functions as a selection signal of the colon display portion 15*c*. Accordingly, if and when the output signal is obtained from the output terminal ODG5 and the output signal is obtained from the terminals ODS7, the colon display portion 15c is enabled to emit light. The display 15 makes a current time display and a timer period display, such that in case of the current time display the current time of say two o'clock, thirty-five minute is displayed as "2:35" and in case of the timer period display the timer period of say thirteen minutes, thirty seconds is displayed as "1330".

Returning to FIG. 6, the output terminal OB of the microprocessor 201 is a buzzer terminal. If and when an output terminal is obtained at the terminal OB, the transistor 205 coupled thereto is rendered conductive, whereby the buzzer 207 is driven to raise an alarm. The buzzer 207 is used to generate a confirmation alarm responsive to a key operation of the above described operation portion 16, completion of cooking, and the like. However, the buzzer 207 may also be used as one of alarming means to be described subsequently.

The input terminal IC1 of the microprocessor 201 is an input terminal for detecting an opened/closed state of the door 14 shown in FIG. 1. More specifically, a door switch 209 adapted to be turned on responsive to the door switch knob 18 (FIG. 1) is connected to the input terminal IC1. Accordingly, in the absence of the input signal at the terminal IC1, i.e. if and when the door switch 209 is turned off, the microprocessor 201 determines that the door 14 has been opened. In such a situation, the microprocessor 201 performs necessary operations such as interruption of its own operation, and the like.

The input terminal RESET is a terminal for initially resetting the microprocessor 201 upon turning on of a power supply to the microwave oven. More specifically, if and when the power supply is turned on, the rise of the source voltage $V_C$ obtained from the control voltage source 133 is detected by means of a detecting circuit 213 implemented by a transistor and a Zener diode. The outpt from the detecting circuit 213 is applied to the terminal RESET. Then the microprocessor 201 resets the respective portions to an initial condition.

An interrupt signal is applied to the input terminal INT of the microprocessor 201. More specifically, the time base signal obtained from the above described control voltage source 133 is an alternating current signal of say 60 Hz and is shaped into a pulse signal of say 60 Hz by means of a wave shaping circuit 219 comprising a transistor, a diode and a capacitor, whereupon the pulse signal is applied to the input terminal INT. Each time the pulse signal obtained from the wave shaping circuit 219 is applied to the input terminal INT, the microprocessor 201 interrupts any other processing, whereupon timing processing is performed. More specifically, the microprocessor 201 functions to generate a signal representing "second", a signal representing "minute", and a signal representing "hour" in synchronism with the above described pulse signal of 60 Hz.

The output terminals OM, OH and OT are a heat command terminal and an output level command terminal, respectively. In performing a heat processing operation using a magnetron 105 the microprocessor 201 just provides an output signal at the output terminal OM and then provides an output signal at the output terminal OT with a slight delay. Upon completion of execution of the heating operation, the output signals at the two terminals OM and OT are caused to disappear. If and when the output signal is obtained at the output terminal OP, the transistor 145 is rendered conductive and accordingly the relay 121 is energized. Accordingly, the normally closed contact 123a is turned off and the normally opened contact 125a is turned on. Accordingly, a short circuit state of the gate electrode 119 of the bidirectional thyristor 107 is released and the blower motor 121 is energized. When the output is obtained from the output terminal OM thereafter, the transistor 131 is rendered conductive and the photocoupler 117 becomes operative. Then the output signal at the output terminal OM is obtained for a time period associated with an output level being set within each cycle which is determined as 10 seconds, for example. Assuming that a microwave output generated by the magnetron 105 is selected to be the maximum level, for example, the output signal is obtained for full period of time in each cycle, and assuming that the microwave output is selected to be a 50% level, the output signal is obtained for five second, for example, within each cycle. Furthermore, a heating operation by the use of a heater 137 is controlled with the outputs from the output terminals OH and OT.

The microprocessor 201 further comprises two output terminals OLa and OLb. The output terminals OLa and OLb are used to indicate which one the display by the display 15 is related to, "BLOCK A" or "BLOCK B" in FIG. 13. More specifically, the output terminal OLa is connected to the base electrode of the transistor 231 for driving the display lamp 161a and the output terminal OLb is connected to the base electrode of the transistor 233 for driving the display lamp 161b. Accordingly, in the presence of the output from the output termial OLa the display lamp 161a is lighted, whereby an indication is made to an operator that a display by the display 15 is related to the set time period by the timer operation knob 162a provided in the circle "BLOCK A". Similarly, the output is obtained from the output terminal OLb, when the display by the display portion 15 is related to the set time period by the time operation knob 162b provided in the circle "BLOCK B".

The microprocessor 201 further comprises an input terminal IC2. The input terminal IC2 is allotted for a temperature detection input terminal on the occasion of a temperature operation. The input terminal IC2 is connected to receive the output of the comparator 223. One input of the comparator 223 is connected to receive a voltage from the junction of a thermistor 11 provided operatively coupled to the cooking chamber 12 and the resistor 225. The other input of the comparator 223 is connected to receive a voltage from the junction of a variable resistor 227 and a resistor 229. The thermistor 11 may be provided on the outside of the upper wall of the cooking chamber 12, as shown by the dotted line in FIG. 1. Alternatively, the thermistor 11 may be provided in the vicinity of an exhaust port, not shown, so that the temperature of the exhaust from the cooking chamber may be detected. The variable resistor 227 is provided so as to be rotated by the temperature adjustment knob 163 depicted in conjunction with FIG. 3, so that a resistance value thereof may be changed as a function of the rotation of the knob 163. The comparator 223 provides an output when the terminal voltage from the thermistor 11 exceeds the terminal voltage of the variable resistor 227 and the output of the comparator 223 is applied to the input terminal IC2. More specifically, the comparator 223 provides the output to the input terminal IC2, if and when the temperature in the cooking chamber detected by the thermistor 11 exceeds a temperature preset by the temperature adjustment knob 163.

Figures 7, 8:
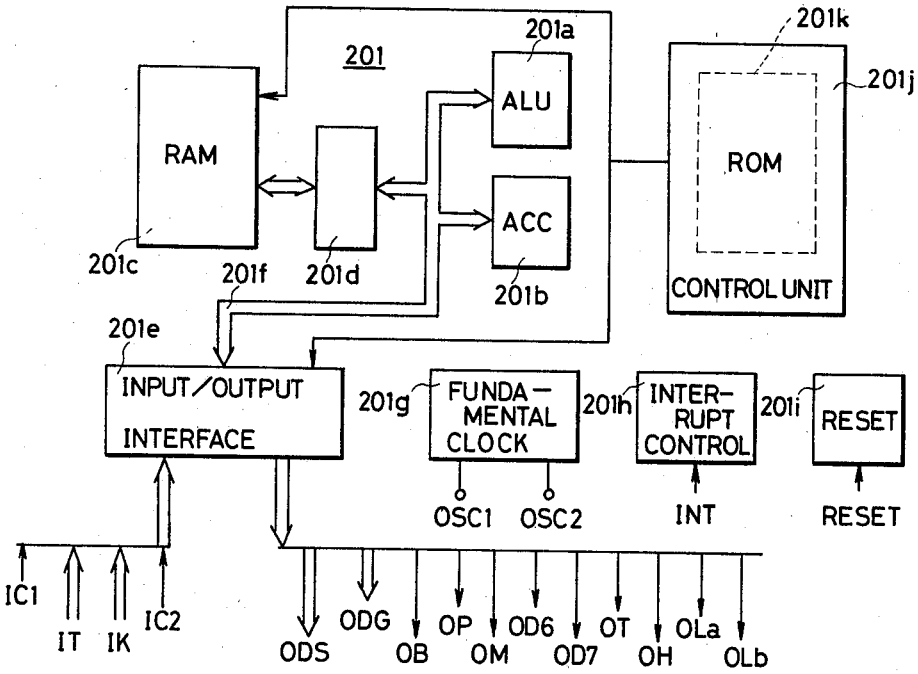
FIG. 7 is a block diagram showing a structure of a microprocessor.
FIG. 8 is a view showing the storing regions of a random access memory.
Figure 9A:
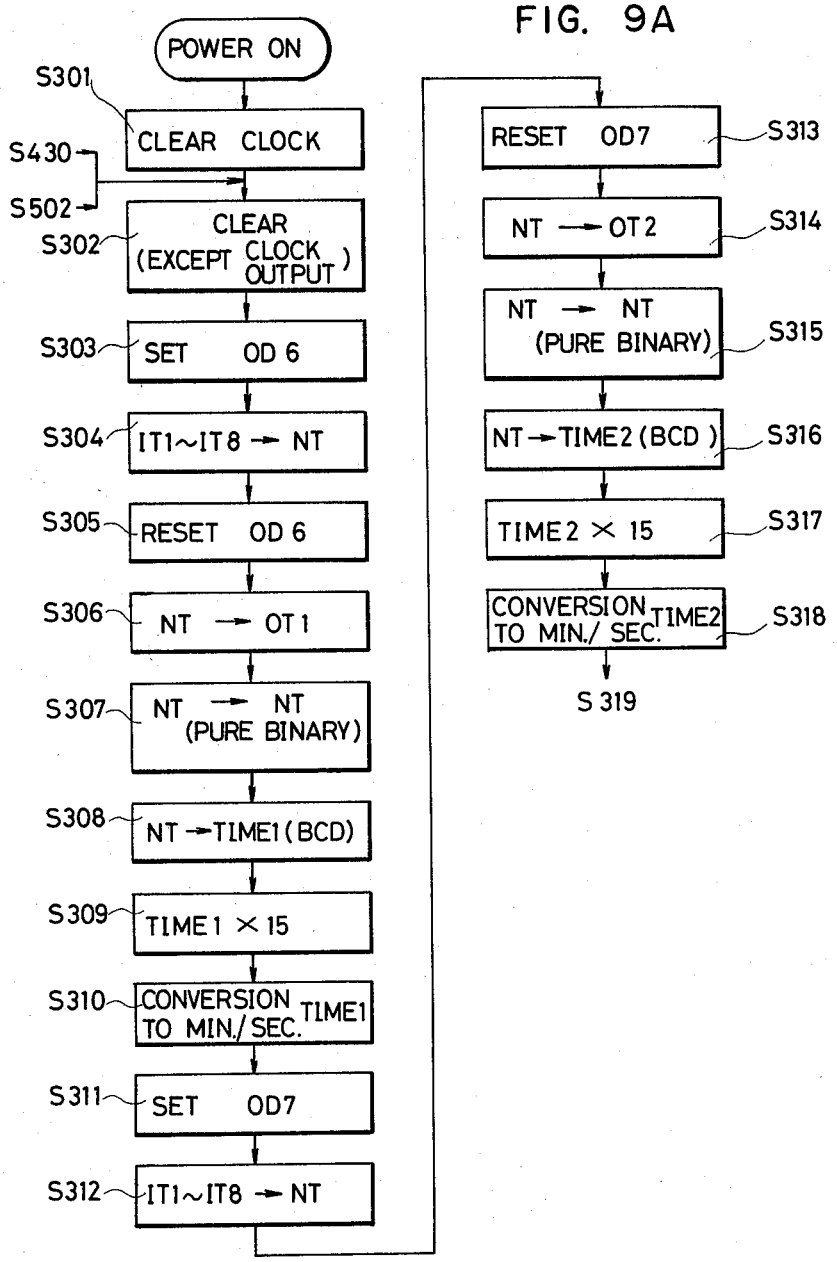
FIGS. 9A to 9H are flow diagrams for explaining a preferred embodiment of the present invention.
Figure 9B:
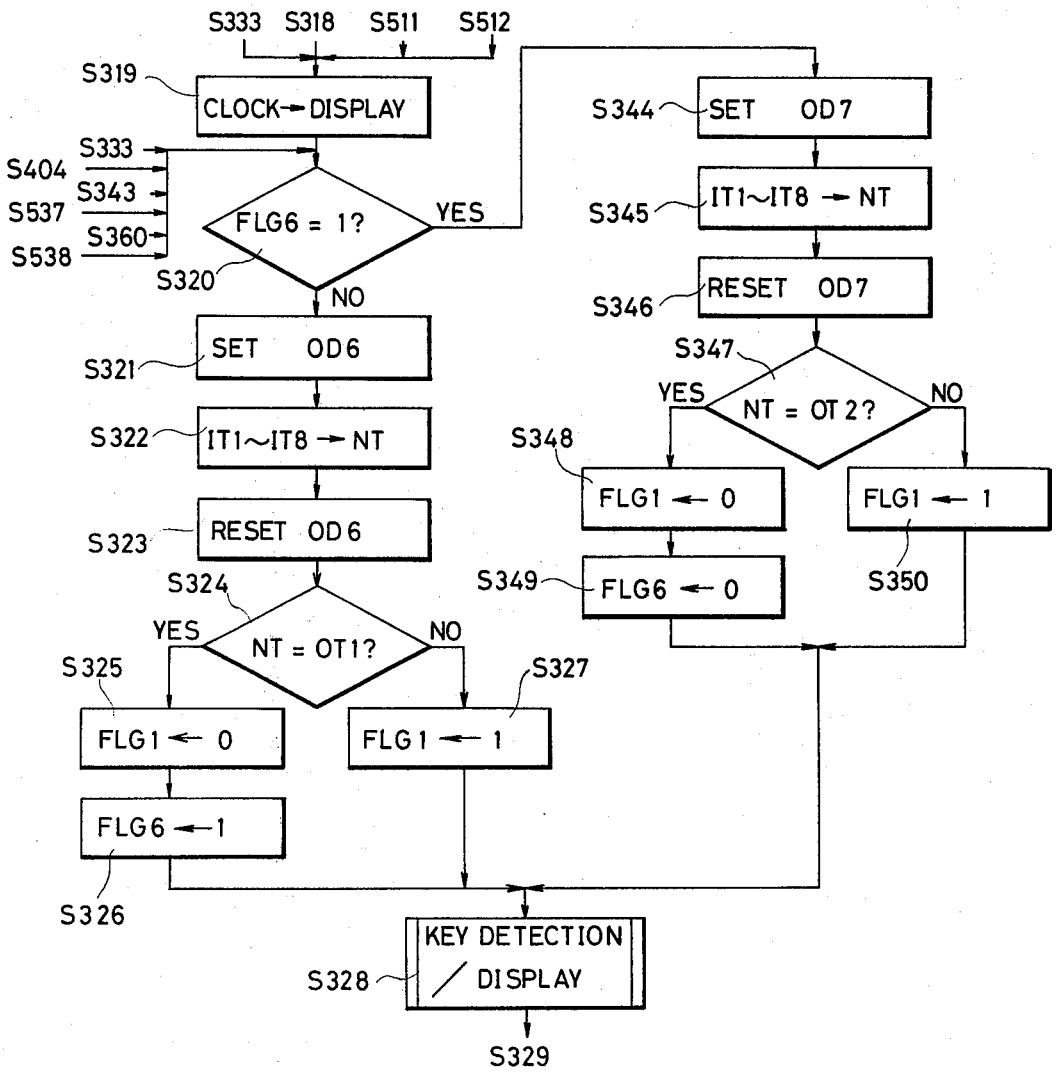
Figure 9C:
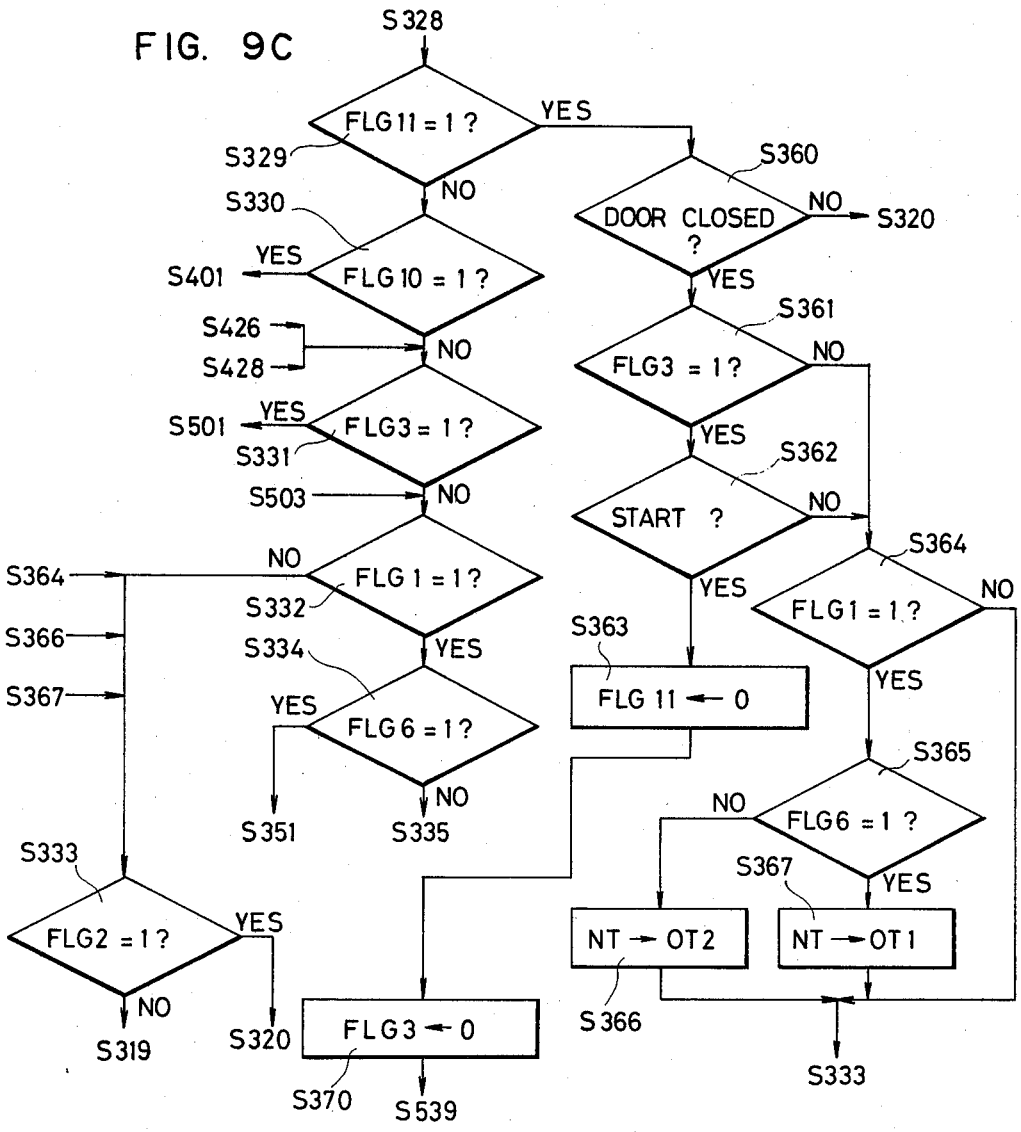
Figure 9D:
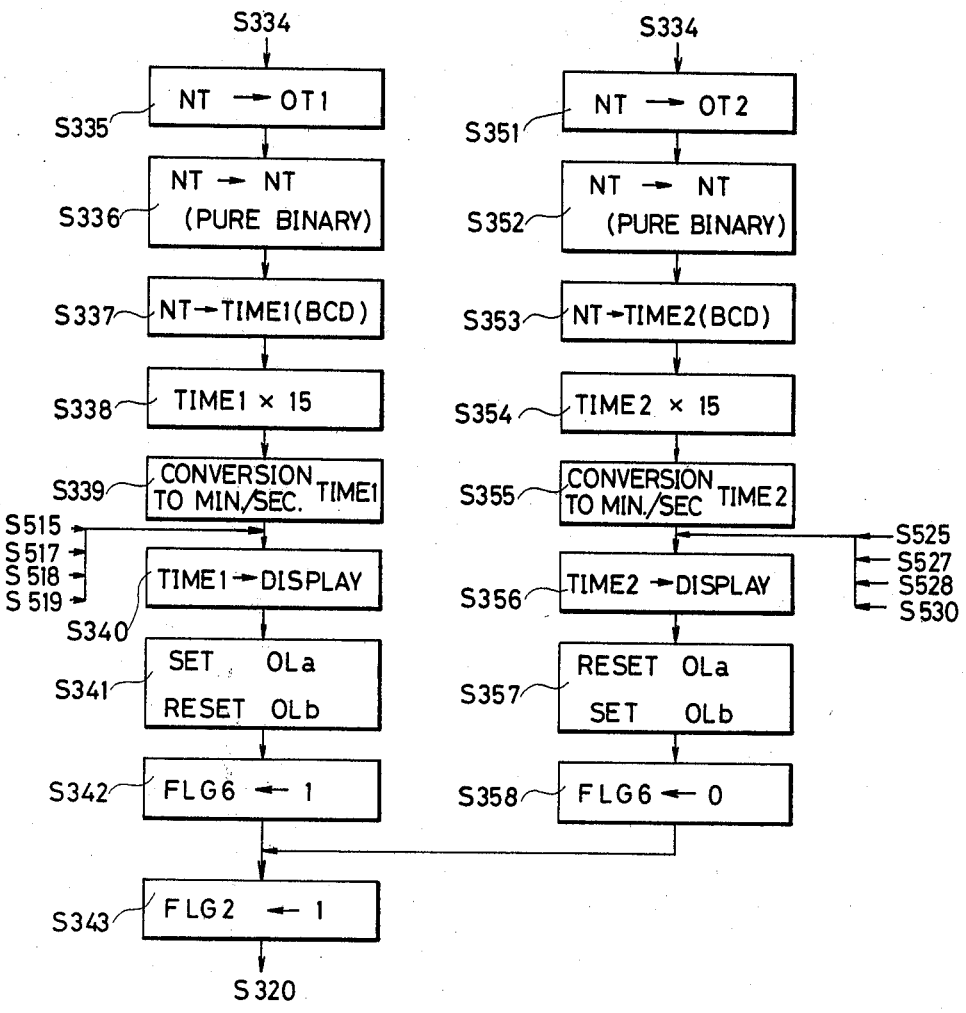
Figure 9E:
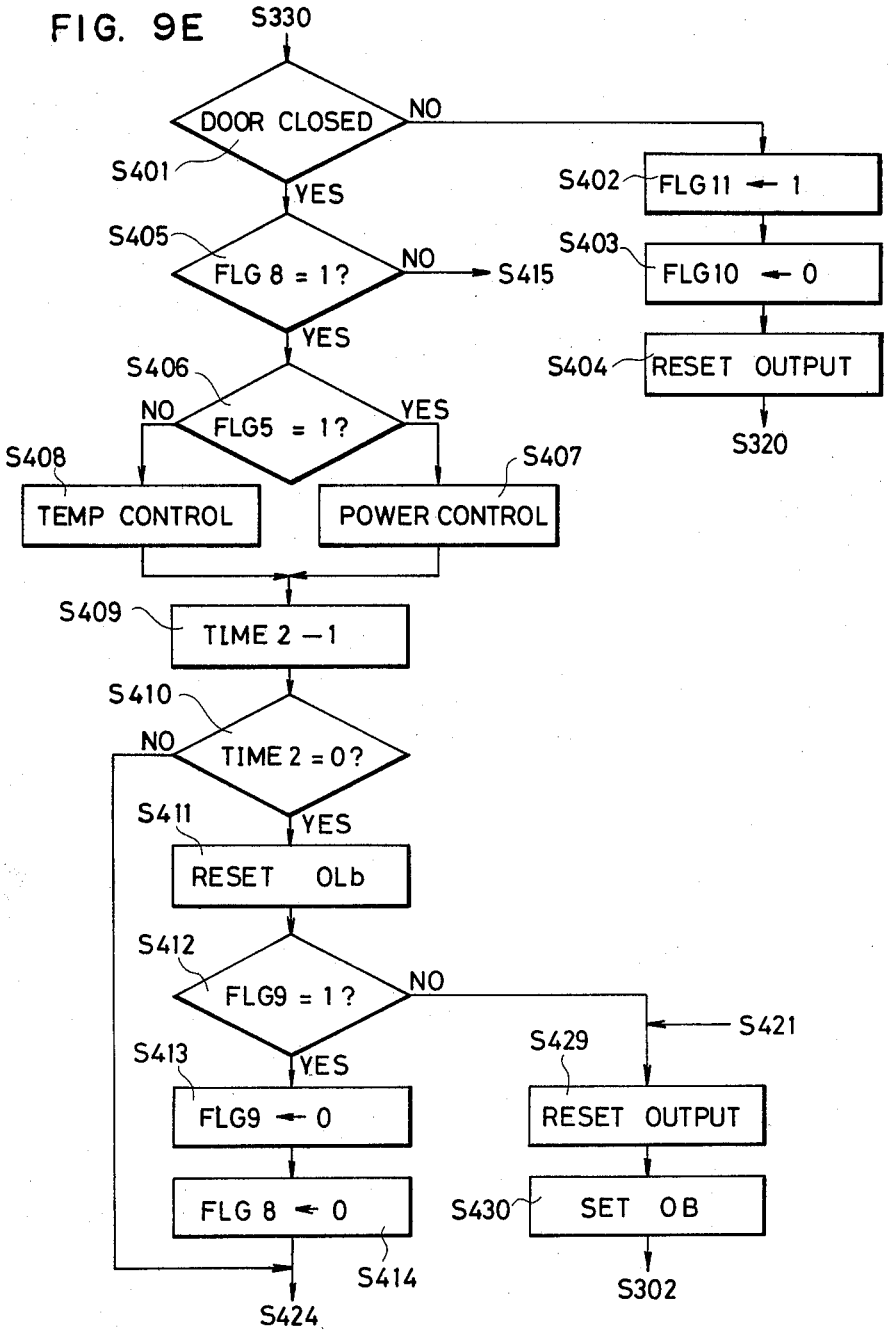
Figure 9F:
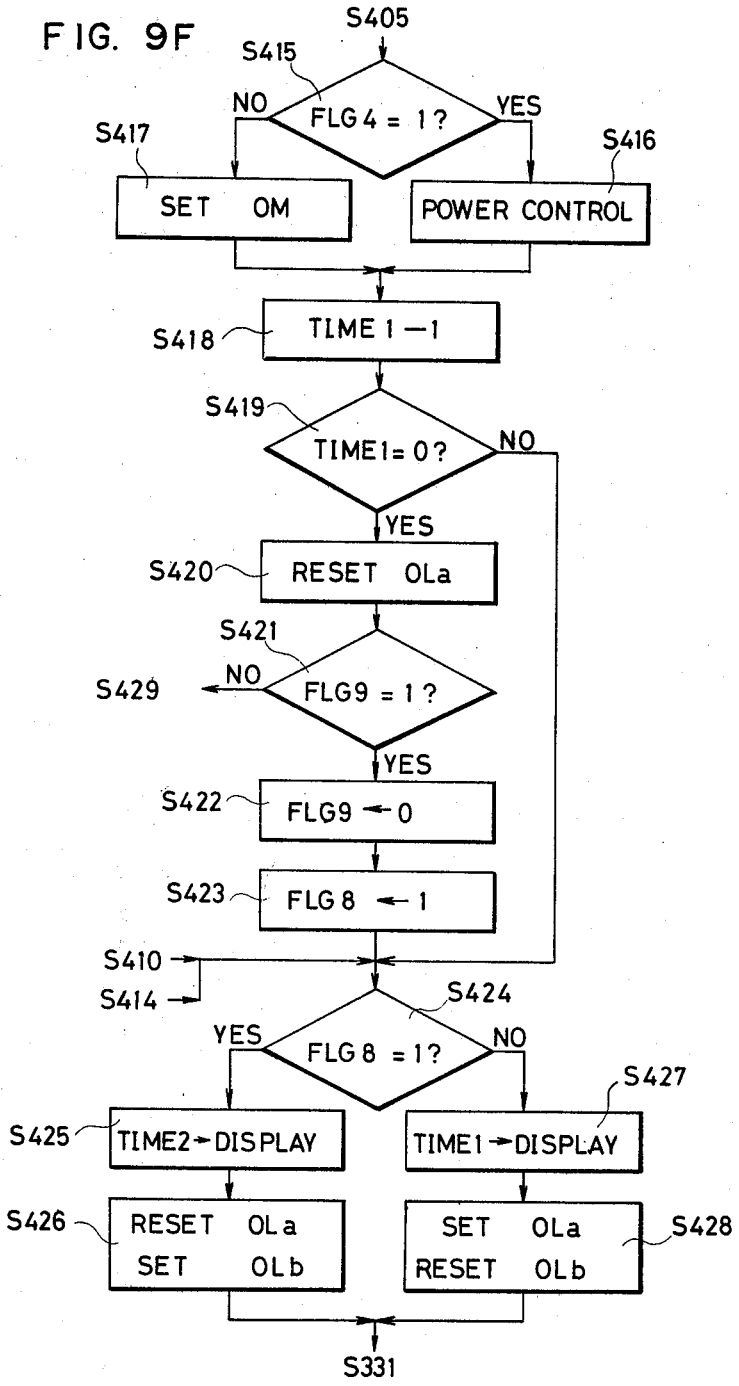
Figure 9G:
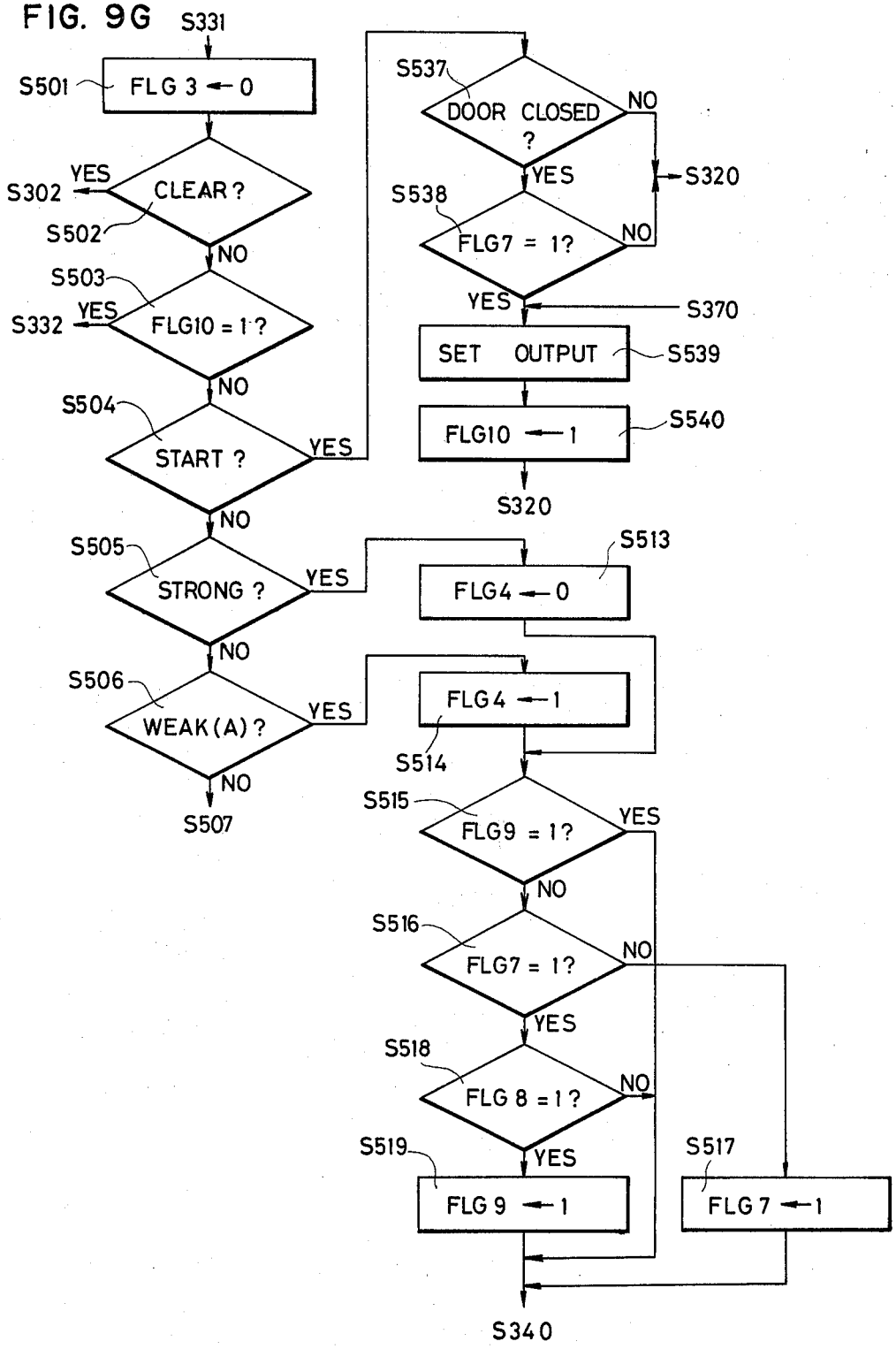
Figure 9H:
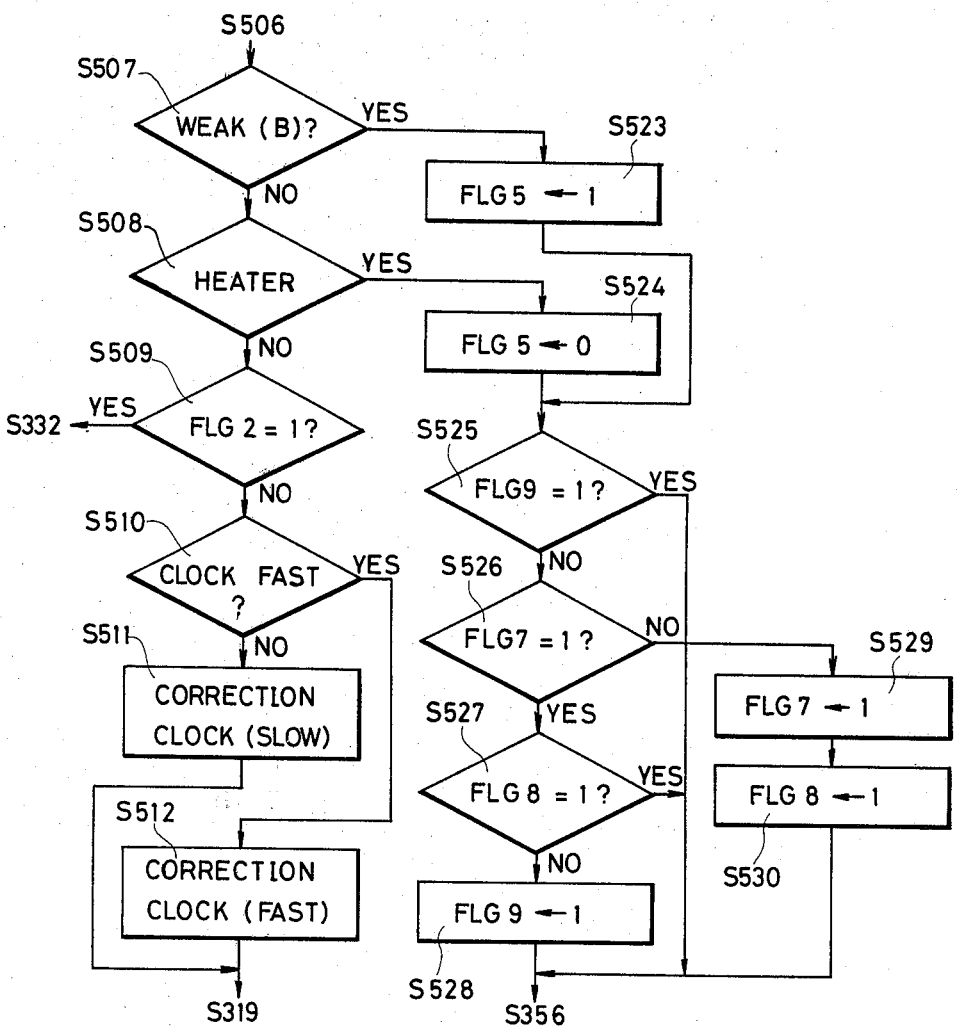

FIG. 7 is a block diagram of the microprocessor 201. The microprocessor 201 comprises an arithmetic logic unit 201*a*, an accumulator 201*b*, a random access memory 1*c*, a random access memory buffer 201*d*, an input-/output interface 201*e* and a control unit 201*j*. A data bus 201*f* is provided for communication of information between these blocks. The control unit 201*j* performs functions of controlling communication of information among these blocks. External input signals IC1, IC2, IT, IK1 to IK4 and external output signals ODS1 to ODS7, ODG1 to ODG5, OB, OM, OH, OT, OD6, OD7, OL*a* and O1*b* are inputted and outputted through the input-/output interface 201*e*.

The microprocessor 201 further comprises a reference clock signal generator 201*g*, an interrupt control unit 201*h* and a reset unit 201*i*. The reference signal generator 201*g* cooperates with an external component 203 shown in FIG. 6 to generate a reference clock signal of 400 kHz, for example. The interrupt control unit 201*h* is responsive to the interrupt signal INT obtained from a wave shaping circuit 219 to command an interrupt operation for the purpose of a required timing operation. The reset unit 201*i* is responsive to the reset signal RESET to command a required reset operation.

The control unit 201*j* comprises a read only memory 2101*k*. The read only memory 201*k* contains a system program and a programmable counter, not shown, to be described subsequently.

The random access memory 201*c* of the embodiment shown comprises the DISPLAY region, the CLOCK region, the TIME1 region and the TIME2 region each of the 4-digit length, as shown in FIG. 8. The random access memory 201*c* further comprises the NT region, OT1 region and the OT2 region each of the 2-digit length. In the embodiment shown the FLG region comprises the regions FLG1 to FLG11 each of one bit. The TIME1 region and the TIME2 region are used to store timer time periods associated with the timer operation knobs 162*a* and 162*b*, respectively. These regions of the 4-digit length are used as output buffers to the display 15. The FLG1 region serves to indicate whether there occurs a change in the position of the timer operation knob 162*a* or 162*b*. The FLG2 region serves to indicate whether a current time display has been made by the display 15. The FLG3 region serves to indicate whether any key operation has been made in the operation portion 16. The FLG4 region serves to indicate whether any one of the "MICROWAVE STRONG" key and the "MICROWAVE WEAK(A)" key has been operated. The FLG5 region serves to indicate whether any one of the "MICROWAVE WEAK(B)" key and "HEATER" key has been operated. The FLG6 region serves to indicate which one of the timer operation knobs 162*a* and 162*b* the timer time period as loaded is. The FLG7 region serves to indicate which one of the keys in the "BLOCK A" and the "BLOCK B" of the operation portion 16 has been operated. The FLG8 region serves to indicate which block key of the "BLOCK A" and "BLOCK B" has been previously operated. The FLG9 region serves to indicate whether any one of the keys in the circles "BLOCK A" and "BLOCK B" has been operated. The FLG10 region serves to indicate whether a heat operation has been performed by means of the magnetron 105 or the heater 137. The FLG11 region serves to indicate whether door 14 (FIG. 1) has been opened in the course of the heat operation.

Now that a structure of a preferred embodiment of the present invention was described in the foregoig, a control operation by the microprocessor 201 will be described in detail in the following.

STANDBY STATE

As far as the microwave oven is in an enabled state, the microprocessor 201 is responsive to the input signal at the input terminal INT to perform a timing operation as described previously irrespective of a key operation by the operation portion 16 and the current time is renewed by a current time storing region which is an accessible region included in the random access memory of the microprocessor 201. Now assuming that no key operation is made by the operation portion 16 and therefore the microwave oven is in a standby state, then the current time is normally displayed by the display 15.

Now that the structural features of the embodiment shown were described in the foregoing, an operation of the embodiment shown will be described with reference to the flow diagram shown in FIGS. 9A to 9H.

Referring to FIGS. 9A to 9H, the rectangle blocks and the rhombus blocks show the respective steps constituting the program, wherein the numbers allotted to the respective blocks indicate the step numbers. In principle, the program proceeds from the block of a smaller step number to a block of a larger step number in the order of arrangement of the respective blocks, except that the program suitably returns to the previous step on the occasion of the return or depending on the decision by the respective determining steps.

Generally out of the steps shown by the rectangle blocks, the steps as indicated as "FLGn→0" and "FLGn→1" (where n=1 to 11) show that the logics zero and one are loaded in the FLGn regions, and out of the steps indicated in the rhombus blocks, the steps indicated as "FLGn=1?" (where n=1 to 11) show that the content in the FLGn region is determined and the content is determined as YES when the same is the logic one whereas the same is determined as NO when the same is the logic zero.

Now in the following the remaining steps will be described.

Step S301: The step is automatically executed responsive to the input signal to the terminal RESET of the microprocessor on the occasion of turning on of a power supply to the microwave oven and the clock associated region including the CLOCK region of the random access memory is cleared.

Step S302: All the output terminal signals of the microprocessor and all the other regions of the random access memory excluding the above described clock associated regions are cleared.

Steps S303 and S321: The output is obtained from the output terminal OD6 of the microprocessor and accordingly the signal of 8 bits is obtained from the signal generator 20*a* depending on the position of the timer operation knob 162*a* at that time and is applied to the input terminal IT1 to IT8 of the microprocessor.

Steps S304, S312, S322 and S345: The signals being applied to the input terminals IT1 to IT8 of the microprocessor are as such stored in the NT region.

Steps S305 and S323: The output of the output terminal OD6 of the microprocessor is reset to disappear.

Steps S306, S335 and S367: The content in the NT region is transferred to the OT1 region, while the content in the NT region is held even after the above described transfer.

Steps S307, S315, S336 and S352: The content in the NT region undergoes code conversion, whereby the original Gray code of 8-bits is converted into a binary code of 8-bits, such code conversion being performed in the same manner as described in conjunction with the previous embodiments.

Steps S308 and S337: The content in the NT region is converted from the binary code further to the binary coded decimal code of 4 digits, whereupon the code is stored in the TIME1 region, such conversion being performed through a well-known logical operation.

Steps S309 and S338: The numerical value loaded in the TIME1 region at the steps S308 and S337 coincide with the number of the unit minor graduation (FIG. 5A) counted from the origin point of the timer operation knob 162*a*. Since the unit minor graduation corresponds to 15 seconds, the content in the TIME1 region is multiplied by 15 at the following steps S309 and S338. As a result, the content in the TIME1 region becomes a value of a timer time period indicated in terms of second and corresponding to the position of the timer operatoin knob 162*a*. For example, assuming that the operation knob 162*a* is at the position of five minutes thirty seconds, the content in the TIME1 region becomes "0330".

Steps S310 and S339: The content in the TIME1 region represented in terms of second at the previous steps S309 and S338 is converted to the value in terms of the minute and second unit. More specifically, in the case of the above described example, "0330" is converted into "0530".

Steps S311 and S344: The output is obtained at the output terminal OD7 of the microprocessor. Accordingly, the signal of 8-bits corresponding to the position of the timer operation knob 162*b* is obtained from the signal generator 20*b* and is applied to the input terminal IT1 to IT8 of the microprocessor.

Steps S313 and S346: The output of the output terminal OD7 of the microprocessor is reset to disappear.

Steps S314, S351 and S336: The content in the NT region is transferred to the OT2 region. The content in the NT region is held even after the above described transfer.

Steps S316 and S353: As in the case of the previous steps S308 and S337, the content in the NT region is converted from the binary code of 8-bits to the binary coded decimal code of 4-digits and is loaded in the TIME2 region.

Steps S317 and S354: As in the case of the previous steps S309 and S338, the timer time period information concerning the timer operation knob 162*b* is converted to the value in terms of a second unit and is loaded in the TIME2 region.

Steps S318 and S355: As in the case of the previous steps S310 and S339, the content in the TIME2 region is converted into the value in terms of the minute and second units.

Step S319: The content in the CLOCK region is transferred to the DISPLAY region. After such transfer the content in the CLOCK region is maintained.

Step S324: It is determined whether the respective contents in the NT region and the OT1 region are equal to each other.

Step S328: A display is made by the display 15 and the same time key operation by the operation portion 16 is detected. More specifically, the outputs are in succession obtained at the input/output control terminals ODG1 to ODG5. At the same time, the contents of the respective digits of the DISPLAY region undergo code conversion in synchronism with the outputs obtained at these terminals ODG1 to ODG4 and the converted outputs are obtained from the display output terminals ODS1 to ODS7. At that time unnecessary zeros in the more significant digits are suppressed from being displayed. The content in the FLG2 region is determined and if the same is determined as the logic zero the output is obtained at the terminal ODG7 in synchronism with the output of the control terminal ODG5 for the purpose of displaying the current time, whereby a colon display is made by the display 15. On the other hand, in the case where key operation is made by the operation portion 16, the key operation is detected through the key signal input terminals Ik1 to IK4 and the code corresponding to the said key is stored in the FKB region, while the logic one is loaded in the FLG3 region, whereby the fact of the key operation is stored.

Steps S340 and S427: The content in the TIME1 region is transferred to the DISPLAY region. Even after the above described transfer the content in the TIME1 region is maintained.

Steps S341 and S428: The outputs at the output terminals OLb and OLa of the microprocessor are set to be off and on, respectively.

Step S347: It is determined whether the respective contents in the NT region and the OT2 region are equal to each other.

Steps S356 and S425: The content in the TIME2 region is transferred to the DISPLAY region. Even after the above described transfer the content in the TIME2 region is maintained.

Step S357 and S426: The outputs of the output terminals OLa and OLb of the microprocessor are set to be off and on, respectively.

Step S362: The content in the FKB region is checked, whereby it is determined whether the same corresponds to the START key or not.

Steps S360, S401 and S537: An opened/closed state of the door 14 is checked through the input terminal IC1 of the microprocessor.

Steps S404 and S429: All the outputs at the output terminals OM, OH and OT of the microprocessor are turned off.

Steps S407 and S416: The output is generated with a 30% duty at the output terminal OM of the microprocessor. More specifically, on the occasion of a heat operation by a microwave, the program passes the steps S407 and S416 at the rate of a number of times per second, as will become apparent from the following description. On the occasion of the first passage of the steps S407 and S416, the output of the output terminal OM is turned on and on the occasion of the passage of the above described steps after the lapse of three seconds the output of the output terminal OM is turned off, whereupon on the occasion of the passage of the above described steps after the lapse of seven seconds thereafter again the output of the output terminal OM is turned on, whereupon the above described process is repeated. On the occasion of a heat operation the output is also obtained at the output terminal OT and the above described steps S407 and S416 are repeated, whereby the magnetron 105 makes oscillation with the cycle of 10 seconds, and for three seconds for each cycle. The oscillation output on that occasion is determined to be 180 W.

Step S408: The presence or absence of the input to the input terminal IC2 of the microprocessor is checked and in the presence of the input the output terminal OH is turned off, whereas in the absence of the input the output at the output terminal OH is turned on.

Step S409: The content of the TIME2 region is subtracted for every second. More specifically, as in the case of the previous step S407, on the occasion of a heat operation, the program passes the step S409 at the rate of a number of times per second, while the above described subtracting operation is made for each passage of one second.

Step S410: It is determined whether the content in the TIME2 region has become zero or not.

Step S411: The output of the output terminal OLb of the microprocessor is turned off.

Step S417: The output of the output terminal OM of the microprocessor is turned on.

Step S418: As in the case of the previous step S409, the content in the TIME1 region is subtracted for each second.

Step S419: It is determined whether the TIME1 region is zero.

Step S420: The output of the output terminal OLa of the microprocessor is turned off.

Step S430: The output is obtained for one second at the output terminal OB of the microprocessor, whereupon the program proceeds to the step S302.

Steps S502, S504 to S508 and S510: The content in the FKB region is checked at these steps to determine whether the same corresponds to any one of the CLEAR key, the START key, the MICROWAVE STRONG key, the MICROWAVE WEAK(A), the MICROWAVE WEAK(B) key, HEATER key, and the CLOCK FAST key. In the case where the same does not correspond to any one of them, the program determines the same as the CLOCK SLOW key and proceeds to the step S511.

Step S511 and S512: At these steps the content in the CLOCK region changes at the speed quicker than the normal speed. More specifically, since the least significant digit of the content of the CLOCK region is the minute unit, normally the content is renewed for every minute; however, at the step S511 the renewal is made for each second at the step S512 renewal is made for every 0.5 second.

In the following a control operation of the microprocessor will be described in more detail.

[1] Initiation of Power Supply and Current Time Setting

Upon initiation of a power supply to the microwave oven, the program proceeds through the steps S301 to S323 o the step S324. At that time the timer time period loaded at the steps S306 and S322 remains the same unless the timer operation knob **162*a* is turned. Accordingly, the program proceeds after the step S324 through the steps S325, S326, S328 to S330 to the step S331. Now assuming that no key operation is made by the operation portion 16, the program proceeds from the step S331 through the steps S332 and S333 to return to the step S319. The program further proceeds to the step S320. Since the content in the FLG6 region has become the logic one at that time through the step S326, the program then proceeds to the step S344. The timer time period loaded at the steps S314 and S345 remains the same unless the timer operation knob 162*b* is turned. Accordingly, the program proceeds after the step S347 through the steps S348 and S349 to return to the step S328. Accordingly, similarly thereafter the program makes alternately circulations of the first loop including the steps S319 to S326 and S328 to S333 and the second loop including the steps S319, S320, S344 to S349 and S328 to S333. In the course of the above described circulations, the content in the CLOCK region is transferred to the DISPLAY region at the step S319 and is displayed by the display 15 at the step S328**. Although the content displayed is a current time display, the displayed current time is incorrect, since the current time setting has not been made at that time.

When the CLOCK FAST key or the CLOCK SLOW key is depressed for the purpose of setting the current time, the key operation is detected at the step S331 in the above described circulation process. Thereafter the program proceeds from the step S331 to the step S501, whereupon the program proceeds through the steps S502 to S510 and further through the step S511 or S512 to return to the step S319. Accordingly, insofar as the CLOCK FAST key or the CLOCK SLOW key is kept depressed, the program makes circulation of the steps S319 to S326 (or the steps S319, S320, S344 to S349) and the steps S328 to S331, S501 to S510 and S511 or S512, whereby a displayed current time in the display 15 quickly changes during that time period.

At the time point when the displayed current time reaches a correct current time, the above described key is released from being depressed, whereupon the program again makes circulation of the above described first loop or the second loop, while the correct current time is displayed by the display 15. Such state is a standby state.

[II] Microwave Strong Heat Operation→Microwave Weak Heat Operation

Consider a case where a heat cooking operation is performed for 25 minutes with a microwave of a strong output (600 W) and then a heat cooking operation is performed for 40 minutes with a microwave of a weak output (180 W). In such a case, first of all the timer operation knobs **162*a* and 162*b* are set to the graduation positions of 25 minutes and 40 minutes, respectively, in the operation portion 16**.

Assuming that the timer operation knob **162*a* is first operated, then such timer operation is detected at the step S324 in the above described standby state and the program then proceeds through the steps S327 to S332 and S334 to S343. More specifically, the new timer time period information of "25 minutes" is loaded in the TIME1 region at the step S339 and the same is also transferred to the DISPLAY region at the step S340. Furthermore, only the display lamp 161*a* is lighted at the step S341. The program then makes alternately circulations of the third loop including the steps S320, S344 to S349, S328 to S333 and the fourth loop including the steps S320 to S326, S328 to S333. During the circulation period the timer time period information of "25 minutes" is displayed at the step S328 and the display lamp 161*a* is also lighted, whereby it is notified that the displayed content in the display 15 contains the time period information associated with the timer operation knob 162*a***.

Assuming that the timer operation knob **162*b* is then operated, such operation is detected at the step S347 in the above described third loop circulation and the program then proceeds through the steps S350, S328 to S332 to S334, S351 to S358, S343. More specifically, the new timer time period of "40 minutes" is loaded in the TIME2 region at the step S355. At the same time the timer time period information is transferred to the DISPLAY region at the step S356 and only the display lamp 161*b* is lighted at the step S357. Thus the program thereafter makes alternately the circulations of the above described third and fourth loops, while the timer time period information of "40 minutes" is similarly displayed by the display 15 and the display lamp 161***b* is lighted, whereby it is notified that the displayed content in the display 15 contains the time period information associated with the timer operation knob 162*b*.

As for the order of operation of the timer operation knobs 162*a* and 162*b*, either may be earlier operated and the time period information designated by the knobs 162*a* and 162*b* is loaded in the respective TIME1 and TIME2 regions. The time period information of the last operated knob is displayed by the display 15 and the display lamp 161*a* or 161*b* is lighted, whereby it is indicated which knob the displayed content in the display 15 corresponds to.

Then the MICROWAVE STRONG key, the MICROWAVE WEAK(B) key, and the START key are operated in succession.

The key operation of the MICROWAVE STRONG key is detected at the step S331 in the above described circulations of the third and fourth loops. Then the program proceeds through the steps S501 to S505, S513, S515 to S517, S340 to S342, while the key operation of the MICROWAVE STRONG key is loaded at the step S513. The key operation of any one of the keys in the circle indicated as "BLOCK A" in the operation portion 16 is stored at the step S517. The content in the TIME1 region is transferred to the DISPLAY region at the step S340 and only the display lamp 161*a* is lighted at the step S341. Insofar as the MICROWAVE STRONG key is kept operated, the program makes alternately circulations of the loop including the steps S320, S344 to S349, S328 to S331, S501 to S505, S513, S515, S516, S518, S340 to S343 and the loop including the step S320, to S326, S328 to S331, S501 to S505, S513, S515, S516, S518, S340 to S343. When the above described key operation is released, the program makes alternately circulations of the fourth loop including the steps S320 to S326, S328 to S333 and the third loop including the steps S320, S344 to S349, S328 to S333. During the above described circulation processes, the time period information designated by the timer operation knob 162*a* is displayed by the display 15 and the display lamp 161*a* is lighted.

The following key operation of the MICROWAVE WEAK(B) key is detected at the step S331 in the course of the above described circulation processes of the third and fourth loops. Then the program proceeds through the steps S501 to S507, S523, S525 to S528, S356 to S358, S343, while the key operation of the MICROWAVE WEAK(B) key is stored at the step S523. The key operation of any keys in the circles indicated as "BLOCK A" and "BLOCK B" of the operation portion 16 is stored at the step S528. At the step S356 the content in the TIME2 region is transferred to the display region and at the step S357 only the display lamp 161*a* is lighted. Insofar as the MICROWAVE WEAK(B) key is kept operated, the program makes alternately circulations of the loop including the steps S320 to S326, S328 to S331, S501 to S507, S523, S525, S356 to S358, S343 and the loop including the steps S320, S344 to S349, S328 to S331, S501 to S507, S523, S525, S356 to S358, S343. When the above described key operation is released, the program makes alternately circulations of the fourth loop including the steps S320 to S326, S328 to S333 and the third loop including the steps S320, S344 to S349, S328 to S333. In the course of the above described circulation processes, the time period information designated by the timer operation knob 162*b* is displayed and the display lamp 161*b* is lighted.

The content in the FLG8 region remains the logic zero depending on the order of operation of the above described MICROWAVE STRONG key and the MICROWAVE WEAK(B) key. This means that the key in the circle indicated as "BLOCK A" of the operation portion 16 is operated prior to the operation of the key in the circle indicated as "BLOCK B".

The final operation of the START key is detected at the step S331 in the above described circulation processes of the third and fourth loops and the program then proceeds through the steps S501 to S504, S537 to S540. At that time, the transistor 145 (FIG. 6) is turned on at the step S539. The program then proceeds through the steps S320 to S326 (or the steps S320, S344 to S349), the steps S328 to S330, S401, S405, S415, S417 to S419, S424, S427, S428, S331. The transistor 131 is turned on at the step S417 and accordingly oscillation of the magnetron 105 is started.

Insofar as the START key is kept operated, the program proceeds after the step S331 to the step S501, whereupon the program proceeds through the steps S502, S503 to the step S332 and then returns from the step S333 to the step S320.

When the above described key operation is released the program proceeds after the step S331 through the steps S332, S333 to return to the step S320. Thereafter, the program makes alternately circulations of the loop including the steps S320, S344 to S349, S328 to S330, S401, S405, S415, S417 to S419, S424, S427, S428, S331 to S333 and the loop including the steps S320 to S326, S328 to S330, S401, S405, S415, S417 to S419, S424, S427, S428, S331 to S333. At the step S418 the content in the TIME1 region is subtracted for each second and the content thereof is transferred to the DISPLAY region at the step S427, whereby the same is displayed at the step S328 as the timer left time period. The program proceeds through the step S428, when the display lamp 161*a* is lighted, whereby it is indicated that the displayed content in the display 15 relates to the timer operation knob 162*a*. Since the transistors 145 and 131 are kept on during that period, the magnetron 105 is enabled to make continuous oscillation, i.e. with 100% duty, thereby to provide a microwave of 600 W.

If and when the timer time period of "25 minutes" passes, so that the timer left time period becomes zero during the above described circulation processes, the same is detected at the step S419 and the program proceeds through the steps S420 to S426, S331 to S333, S320 to S326 (or the steps S320, S344 to S349), the steps S328 to S330, S401, S405 to the step S406. More specifically, this means that a microwave strong heat operation for 25 minutes is terminated.

The program then proceeds through the steps S407, S409, S410, S424 to S426, S331 to S333. Then the program makes alternately circulations of the loop including the steps S320 to S326, S328 to S330, S401, S405 to S407, S409, S410, S424 to S426, S331 to S333 and the loop including the steps S320, S344 to S349, S328 to S330, S401, S405 to S407, S409, S410, S424 to S426, S331 to S333. At the step S409, the content in the TIME2 region is subtracted for each second and the content thereof is transferred to the DISPLAY region at the steps S425, whereby the same is displayed at the step S328 as the timer left time period. When the program proceeds through the step S426, the display lamp 161*b* is lighted, whereby it is indicated that the displayed content in the display 15 relates the timer operation knob 162*b*. Since the program proceeds through the step S407, the magnetron 15 is enabled to make oscillation with 30% duty, thereby to provide a microwave of 180 W.

When the timer time period of "40 minute" lapses in the above described circulation processes, whereby the timer left time period becomes zero, the same is detected at the step S410. The program then proceeds through the steps S411, S412, S429, S430 to the step S302. As a result, the transistors 143, 131 and 145 are all turned off, whereby a microwave weak heat operation for 40 minutes is terminated, whereupon it is notified by the buzzer 207 (FIG. 6) that all the operations are terminated.

Thereafter the microwave oven enters into the above described standby state and the current time is displayed by the display 15.

[III] Microwave Weak Heat Operation→Microwave Strong Heat Operation

Consider a case where a microwave heat operation of a strong output is performed after a microwave heat operation of a weak output is performed, i.e. in the reversed order as compared with the above described [II] heat operation. In such a case, as in the case of the previous example [II], suitable timer time periods are set by means of the timer operation knobs 162*a* and 162*b*. Then the MICROWAVE WEAK(B) key, the MICROWAVE STRONG key, and the START key are in succession operated.

Upon operation of the MICROWAVE WEAK(B) key, the program proceeds through the steps S507, S523, S525, S526, S529, S530. Upon further operation of the MICROWAVE STRONG key, the program proceeds through the steps S505, S513, S515, S516, S518, S519. Accordingly, if and when the START key is operated in such a case, the same as the previously described example [II] applies; however, the order of the heat operation is reversed, so that a microwave weak heat operation is first performed with 30% duty, whereupon a microwave strong heat operation is performed with 100% duty.

[IV] Microwave Strong Heat Operation→Heater Heat Operation

Now consider a case where a heat cooking operation is performed for 20 minutes with a strong output microwave and then a further heat cooking operation is performed for 30 minutes at the temperature of 200° C. by means of the heater. As in the case of the previously described example [II] timer operation knobs 162*a* and 162*b* are set to the graduation positions of "20 minutes" and "30 minutes". At the same time the temperature adjustment knob 163 is set to the graduation position of 200° C. and then the MICROWAVE STRONG key, the HEATER key and the START key are operated in succession.

Accordingly, the same processing as the above described example [II] is performed at the operation of the MICROWAVE STRONG key. Upon operation of the HEATER key the program proceeds through the steps S508, S524 to S528. Upon further operation of the START key, as in the case of the previously described example [II], first a strong output microwave is generated for 20 minutes, whereupon the program makes alternately circulations of the loop including the steps S320 to S326, S328 to S330, S401, S405, S406, S408 to S410, S424 to S426, S331 to S333 and the loop including the steps S320, S344 to S349, S328 to S330, S401, S405, S406, S408 to S410, S424 to S426, S331 to S333. At that time, as in the previously described examples, the timer left time period is displayed and the display lamp 161*b* is lighted. When the program proceeds through the step S406, the heater 137 is energized if and when the temperature in the cooking chamber 12 (FIG. 1) is lower than 200° C. and is deenergized when the temperature in the cooking chamber 12 (FIG. 1) is higher than 200° C. Accordingly, the temperature in the cooking chamber is maintained approximately at 200° C.

During the above described circulation processes, when the timer time period of "30 minutes" lapses, in the same manner the heater heating operation is terminated and it is notified by the buzzer 207 that all the operations are terminated, whereupon the microwave oven enters into the above described standby state.

[V] Heater Heating Operation→Microwave Strong Heat Operation

Now Consider a case where a microwave heat operation is performed with the strong output after the heater heat opeation is performed, i.e. in the reversed order of the above described example [IV]. In such a case, as in the case of the previously described example [IV], the timer operation knobs 162*a* and 162B and the temperature adjustment knob 163 are set to suitable timer time periods and temperature and then the HEATER key, the MICROWAVE STRONG key, and the START key are operated in succession.

Upon operation of the HEATER key, the program proceeds through the steps S508, S524 to S526, S529, S530. Upon further operation of the MICROWAVE STRONG key, the program proceeds through the steps S505, S513, S515, S516, S518, S519. Accordingly, upon operation of the START key, as in the case of the previously described example [IV] but in the reversed order of the heat operation, first a heater heat operaiton is performed and then a microwave strong heat operation is performed.

[VI] Microwave Weak Heat Operation→Heater Heat Operation

Now consider a case where a heater heat operation is performed after a microwave heat operation is performed with the weak output. In such a case, as in the previously described examples, the timer time periods and the temperature are similarly and suitably set, and whereupon the MICROWAVE WEAK(A) key, the HEATER key, and the START key are operated in succession, as is readily apparent.

[VII] Heater Heat Operation→Microwave Weak Heat Operation

Now consider a case where a microwave heat operation is performed with the weak output after a heater heat operation is performed, i.e. in the reversed order of the above described example [VI]. In such a case, similarly the timer time periods and the temperature are suitably set, whereupon the HEATER key, the MICROWAVE WEAK(A) key, and the START key are operated in succession, as is readily apparent.

[VIII] Sole Heat Operation

Now consider a case where only a microwave heat operation is performed with the strong output. In such a case, the timer time period is set by the timer operation knob 162*a*, whereupon the MICROWAVE STRONG key and the START key are operated in succession. Now a consider a case where a microwave heat operation is performed with the weak output. In such a case, a timer time period is set by the timer operation knob 162*a*, whereupon the MICROWAVE WEAK(A) key, and the START key are operated, the timer time period is set by the timer operation knob 162*a* and then the MICROWAVE WAEK(B) key and the START key are operated. In order to perform a heater heat operation, first the timer operation knob 162*b* and the temperature operation knob 163 are operated to set the time period and the temperature, whereupon the HEATER key and the START key are in succession operated, as is readily apparent.

[IX] Clear Operation

Since the program usually proceeds through the steps S328 and S331, irrespective of whether the microwave oven has been performing a heat operation, the CLEAR key in the operation portion 16 may be operated at any time, when the program proceeds through the steps S331, S501, S502 to return to the step S302, whereupon the microwave unconditionally enters into the standby state.

[X] Interruption of Performance of Heat Operation

Although opening of the door 14 (FIG. 1) of the microwave oven when the microwave oven is not in the heat operation does not affect the control operation by the microprocessor by any means, such opening of the door 14 interrupts the heat operation.

More specifically, since the program proceeds through the step S401 in the course of the heat operation, opening of the door 14 causes the program to proceed through the steps S401 to S404. The heat operation is then terminated at the step S404, whereupon the program makes circulation of the loop including the steps S320 to S326 (or the steps S320, S344 to S349) and the steps S328, S329, S360, insofar as the door 14 is kept open, whereby the timing operation by the timer is interrupted for that period.

When the door 14 is closed thereafter, the program makes circulation of the loop including the steps S320 to S326 (or the steps S320, S344 to S349), the steps S328, S329, S360, S361, S364, S333. When the START key is then operated, the program proceeds through the steps S360 to S363, S370 to enter to the step S539, whereby the above described heat operation is restarted.

In the above described embodiments, signals are applied to the common terminal 27 (FIG. 4) in the timer knobs 162*a* and 162*b* and the timer time period information was introduced from the first to eighth signal terminals 28*a* to 28*h* (FIG. 4) to the microprocessor in the form of a parallel bit signal; however, alternatively signals are entered into the first to eighth signal terminals 28*a* to 28*h*, while the timer time period information may be introduced from the common terminal 27 into the NT region of the microprocessor in the form of serial bit signal.

In the above described embodiments, the heater heat operation was controlled based on the temperature set by the temperature adjustment knob 163; however, a thermistor circuit for detecting a specific temperature, say 250° C., and a key in the circle indicated as "BLOCK B" in the operation portion 16 may be added for the purpose of performing a heater heat operation by fixing the above described specific temperature to a control reference temperature by means of the said key operation. In such a case, a thermistor of the above described thermistor circuit may be shared with a thermistor of the embodiment.

According to the above described embodiment of the present invention, as apparent from the foregoing description of the respective operation examples [II] to [VII], the respective heating modes are automatically performed by the microwave oven in the order of the operations of the heating mode designating keys such as MICROWAVE STRONG key, HEATER key and the like. Therefore, such redundant operations for designating the order of the operations as conventionally required become unnecessary and only a key operation for actual cooking order is sufficient, with the result that a cooking apparatus excellent in convenience of operation is provided. Furthermore, although an increase of the number of the heating condition setting means such as a heating mode designating key and the like requires a very complicated control in order to store the order of the operations by such means, thereby to perform the heating operation in the order, separation of the respective heating condition setting means into blocks in accordance with the present invention, thereby to store the order of operation on a block unit basis can avoid a complicated control. In addition, since in separating the setting means in such blocks, timer time period entry means are provided in association with the respective blocks, a timer time period can be set with ease and without an error for each of the designated heating modes.

As apparent from the above described operation examples [I] to [VII], particularly from the operation examples [I] and [II], described specifically, in a state including a standby state for displaying the current time before and after operation of the START key, the program always and periodically passes the step S324 or S347 and the steps S328 and S332, and therefore when the timer operation knob 162*a* or 162*b* is operated, the new timer time period information corresponding to the operated knob, i.e. corresponding to the operation knob last displaced is loaded in the corresponding one of the TIME 1 region and the TIME 2 region. In the state before the operation of the START key, the timer time period information of the operation knob last displaced is displayed by the display 15. Therefore, in spite of the fact that the apparatus is structured in an electronic controlled manner, in entering a timer time period such a complicated keying input operation as required conventionally is not necessary at all and merely a setting operation of timer means to a desired position is sufficient. Even in the case where a plurality of heating modes are to be performed in succession, the input operation of the respective timer time periods may be made in a similar manner and convenience of operation is excellent.

Furthermore, since the timer time period information is displayed by the above described display on the occasion of operation of the timer means, the operation of the timer means can be readily confirmed with ease. In addition, since it is adapted such that the timer time period information obtained from the timer means as last displaced is selectively displayed by the above described display means, the display means can be commonly used to a plurality of timer means, which also simplifies the structure.

Although in the above described embodiments a specific generator as shown in FIGS. 5A and 5B was employed as the signal generator 20, such may be of a simpler structure.

Figure 10:
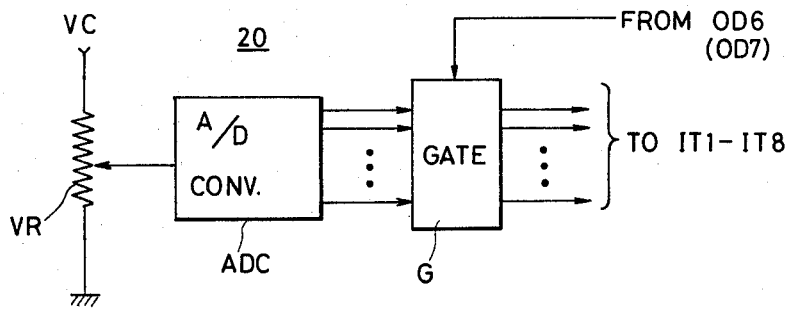
FIG. 10 is an outline block diagram showing another embodiment of the signal generator for use in the present invention.

FIG. 10 is a block diagram showing another embodiment of the signal generator for use in the present invention. The signal generator 20 comprises a variable resistor VR, an analog/digital converter ADC and a gate G.

One end of the variable resistor VR is connected to the ground and the other end thereof is connected to receive a voltage Vc. Although not shown, the sliding contact of the variable resistor VR is coupled to a shaft provided to be rotatable or displaceable in association with an operation of the timer operation knob 19, 162*a* or 162*b*, such as the operation shaft 21 shown in FIG. 4, for example. A voltage drop across the variable resistor VR is applied to the analog/digital converter ADC. The analog/digital converter ADC serves to convert the magnitude of the given voltage to an associated digital signal. The analog/digital converter ADC is structured to provide the the above described digital signal in the form of the Gray code, as previously described in conjunction with FIG. 5A. To that end, the analog/digital converter ADC may comprise a code converting means. The Gray code signal of 8 bits obtained from the analog/digital converter ADC is applied to the gate G. The gate G is also supplied with a pulse signal obtained from the output terminal OD6 (or OD7) of the microprocessor. More specifically, the gate G is responsive to the signal from the output terminal OD6 (or OD7) to be enabled, whereby the digital signal of 8 bits or the code signal obtained from the analog/digital converter ADC is applied to the input terminals IT1 to IT8 of the microprocessor in a bit parallel fashion at that timing. According to the FIG. 10 embodiment, it is not necessary to form the complicated conductive pattern 26 (FIG. 5A) and as a result a timer time period entry means can be implemented with a simple structure.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electronically controlled heat cooking apparatus, comprising:

heating energy generating means for providing heating energy to a material being cooked, entry means for setting heating conditions corresponding to a desired plurality of heating modes successively set in an arbitrary sequence for cooking said material being cooked by means of said heating energy generating means;

said entry means comprising a plurality of groups of heating condition setting means for independently establishing signals corresponding to said heating conditions of a desired heating mode;

each said group of heating condition setting means comprising heat designating means for setting the heat to be applied during a single heating mode, and timer time period entry means for setting a timer time period corresponding to the desired duration of said single heating mode;

storing means for storing signals corresponding to said heating conditions set by said plurality of groups of heating condition setting means and to the sequence in which said groups were successively set, said storing means comprising heat storing means for storing the heat settings entered by said heat designating means, timer time period storing means for storing said timer time periods entered by said timer time period entry means, and sequence storing means, responsive to the sequence in which an operator sets said groups, for identifying the sequence in which said groups have been set regardless of which group said operator chooses to set first;

heat start commanding means, control means responsive to the output of said heating start commanding means and to said signals stored in said storing means for controlling said heating energy generating means to perform said desired sequential heating modes in accordance with the order stored in said order storing means and the heating conditions stored in said heat storing means and said timer time period storing means, and said cooking apparatus further comprising an operation portion having a plurality of discrete sections, each of said sections having a respective group of heating condition setting means disposed therein.

2. An electronic controlled heat cooking apparatus in accordance with claim 1, wherein at least one of said heat designating means comprises strong heat designating means for designating a relatively strong heating operation by said heating energy generating means and weak heat designating means for designating a relatively weak heating operation by said heating energy generating means, and said control means enables said heating energy generating means to generate said energy with a relatively strong intensity when said storing means stores that said strong heat designating means was operated and enables said heating energy generating means to generate said energy with a relatively weak intensity when said storing means stores that said weak heat designating means was operated.

3. An electronic controlled cooking apparatus in accordance with claim 2, wherein said heating energy generating means comprises microwave generating means.

4. An electronic controlled heat cooking apparatus in accordance with claim 1, wherein said heat energy generating means comprises microwave generating means and heater means, at least one of said heating designating means comprises microwave heat designating means for designating the heat by said microwave generating means and heater heat designating means for designating the heat by said heater means, and said control means selectively enables said microwave generating means when said storing means stores that said microwave heating designating means was operated and selectively enables said heater means when said storing means stores that said heater heat designating means was operated.

5. An electronic controlled heat cooking apparatus in accordance with claim 1 which further comprises left time period evaluating means for evaluating a left time period based on said timer time period stored in said timer time period storing means and an operation time period of said heating energy generating means, and display means for displaying a left timer time period as evaluated by said left timer time period evaluating means.

6. An electronic controlled heat cooking apparatus in accordance with claim 5, which further comprises section display means for displaying which one of said groups of heating condition setting means is associated with said left time period display by said display means.

7. An electronic controlled heat cooking apparatus in accordance with claim 5, 6 or 1, wherein said timer time period entry means comprises means displaceably operable over a predetermined range from an origin position for entry of said timer time period, and further comprises code signal generating means operatively coupled to said displaceble entry means for generating a code signal which varies according to the displaced amount from said origin position of said displaceable entry means, and said timer time period storing means stores said timer time period based on said code signal obtained from said code signal generating means.

8. An electronic controlled heat cooking apparatus in accordance with claim 7, which further comprises operation detecting means for detecting an operation of said displaceable entry means included in said timer time period entry means, and wherein said timer time period storing means stores said timer time period based on said code signal obtained from said timer time period entry means upon detection of an operation by said operation detecting means.

9. An electronic controlled heat cooking apparatus in accordance with claim 8, wherein said operation detecting means comprises displacement detecting means for detecting displacement of said displaceable entry means.

10. An electronic controlled heat cooking apparatus in accordance with claim 8, wherein said displaceable entry means is structured to maintain the position to which it is displaced after the displacement operation is completed.

11. An electronic controlled heat cooking apparatus in accordance with claim 8, which further comprises timer time period information display means responsive to the output of said operation detecting means for displaying timer time period information presently set by displacement of said displaceable entry means.

12. An electronic controlled heat cooking apparatus in accordance with claim 11, wherein said timer time period information display means is used commonly by said timer time period entry means in said sections, and wherein said common timer time period information display means displays information set by said timer time period entry means last operated, upon detection of the operation last made of said displaceable entry means of said timer time period entry means by means of said operation detecting means.

13. An electronic controlled heat cooking apparatus in accordance with claim 2, wherein said common timer time period information display means displays a timer time period information corresponding to a heating mode being newly performed when said heating mode is begun in accordance with the order as stored in said storing means in the course of a cooking operation.

* * * * *